US006332401B1

(12) United States Patent
Tota et al.

(10) Patent No.: US 6,332,401 B1
(45) Date of Patent: Dec. 25, 2001

(54) METHOD AND APPARATUS FOR PRESSURE WAVE SUPPRESSION IN SMALL-CHARGE BLASTING

(75) Inventors: Edward W. Tota, Mandurah (AU); Mihailo Gavrilovic, Denver; John D. Watson, Evergreen, both of CO (US); Peter N. Georgiou, St. Ives; Jeffrey W. Branson, Mandurah, both of (AU)

(73) Assignee: RockTek Limited (AU)

( * ) Notice: Subject to any disclaimer, the term of this patent is extended or adjusted under 35 U.S.C. 154(b) by 0 days.

(21) Appl. No.: 09/289,527

(22) Filed: Apr. 9, 1999

Related U.S. Application Data

(60) Provisional application No. 60/124,275, filed on Mar. 11, 1999.

(51) Int. Cl.[7] ..... F42D 3/00; F42B 3/00

(52) U.S. Cl. ..... 102/303; 102/302; 102/312; 102/313; 102/333; 102/301

(58) Field of Search ..... 102/301, 302, 102/303, 312, 313, 333

(56) References Cited

U.S. PATENT DOCUMENTS

| | | | |
|---|---|---|---|
| 1,585,664 | 5/1926 | Gilman | 102/22 |
| 3,623,771 | 11/1971 | Sosnowicz et al. | 299/12 |
| 3,735,704 | 5/1973 | Livingston | 102/23 |
| 3,848,927 | 11/1974 | Livingston | 299/13 |
| 3,943,853 | 3/1976 | Robertson et al. | 102/22 |
| 3,945,319 | 3/1976 | Meagher | 102/22 |
| 3,960,082 | 6/1976 | Sloevsky et al. | 102/22 |
| 4,040,355 | 8/1977 | Hopler, Jr. | 102/22 |
| 4,315,463 | 2/1982 | Arcand | 102/303 |
| 4,754,705 | 7/1988 | Worsey | 102/333 |
| 4,900,092 | 2/1990 | Van Der Westhuizen et al. | 299/13 |
| 5,098,163 | 3/1992 | Young, III | 299/13 |

(List continued on next page.)

FOREIGN PATENT DOCUMENTS

| | | |
|---|---|---|
| 71 742/74 | 7/1974 | (AU) . |
| 8539461 | 3/1985 | (AU) . |
| 73614/87 | 5/1987 | (AU) . |
| 33867/93 | 2/1993 | (AU) . |
| 41210/93 | 11/1993 | (AU) . |
| B-30436/92 | 1/1995 | (AU) . |
| 73576/96 | 3/1997 | (AU) . |
| 0 311 025 | 5/1988 | (EP) . |
| 800883 | 9/1958 | (GB) . |

(List continued on next page.)

OTHER PUBLICATIONS

McCarthy; "Hydro–Fracturing Technology for Secondary Rock Breaking"; Eighth High–Tech Seminar Jul. 20–24, 1998; pp. 47–60.

Persson et al., "Rock Blasting and Explosives Engineering", Chapters 12–14, pp. 319–386, 1994, CRC Press, Inc.

(List continued on next page.)

*Primary Examiner*—Peter A. Nelson
(74) *Attorney, Agent, or Firm*—Sheridan Ross P.C.

(57) ABSTRACT

The present invention is directed to a method for selecting pressure wave suppression devices from among a menu of pressure wave suppression devices to satisfy the pressure wave requirements of a given job or application. The present invention is further directed to pressure wave suppression devices that can be used in the hole, at or near the opening of the hole, or at a distance from the hole to perform pressure wave and/or flyrock protection. The invention is particularly useful in suppressing airblast and other excavation equipment noise in urban areas.

36 Claims, 17 Drawing Sheets

U.S. PATENT DOCUMENTS

| | | | | |
|---|---|---|---|---|
| 5,225,622 | | 7/1993 | Gettle et al. | 86/50 |
| 5,308,149 | | 5/1994 | Watson et al. | 299/13 |
| 5,375,527 | * | 12/1994 | Nakajima | 102/301 |
| 5,472,769 | | 12/1995 | Goerz, Jr. et al. | 428/138 |
| 5,482,754 | | 1/1996 | Crook | 428/54 |
| 5,551,344 | * | 9/1996 | Couet et al. | 102/313 X |
| 5,563,364 | | 10/1996 | Alhamad | 102/303 |
| 5,576,511 | * | 11/1996 | Alhamad | 102/303 |
| 5,654,053 | | 8/1997 | Crane et al. | 428/36.5 |
| 5,728,967 | | 3/1998 | Parkes | 102/303 |
| 5,765,923 | | 6/1998 | Watson et al. | 299/13 |
| 5,803,550 | | 9/1998 | Watson et al. | 299/13 |
| 6,119,574 | * | 9/2000 | Burky et al. | 102/303 X |
| 6,155,172 | * | 12/2000 | Nakajima | 102/302 X |

FOREIGN PATENT DOCUMENTS

| | | |
|---|---|---|
| WO 91/02212 | 2/1991 | (WO) . |
| WO 92/02709 | 2/1992 | (WO) . |
| WO 95/28551 | 10/1995 | (WO) . |
| WO 97/06402 | 2/1997 | (WO) . |
| WO 97/17588 | 5/1997 | (WO) . |
| WO 98/20295 | 5/1998 | (WO) . |
| WO 98/44309 | 10/1998 | (WO) . |
| WO 99/31457 | 6/1999 | (WO) . |
| WO 99/61864 | 12/1999 | (WO) . |
| 21-01-913432 | 5/1991 | (ZA) . |
| 21-01-952646 | 3/1995 | (ZA) . |
| 21-01-970578 | 1/1997 | (ZA) . |

OTHER PUBLICATIONS

Lundquist; "Underground Tests of the Ream Method of Rock Fragmentation for High–Speed Tunneling"; RETC Proceedings; vol. 1, Chapter 56; 1974; pp. 825–840.

Product advertisement; "Boulder Buster"; 2 pages.

Law et al.; "Unique Blasting Challenges"; *The Journal of Explosive Engineering*; Jan./Feb. 1999; pp. 8–10, 12, 14.

Clark et al.; "Rapid Excavation of Rock with Small Charges of High Explosive"; Jan. 1979; 231 pages.

Young, Chapman; Dick, Richard D.; Fourney, William L., "Small Charge Cone–Fracture Technique for Rapid Excavation", *Fragblast '90*, Aug. 26–31, 1990, Brisbane.

* cited by examiner

METHOD AND APPARATUS FOR PRESSURE WAVE SUPPRESSION IN SMALL-CHARGE BLASTING

RELATED APPLICATIONS

This application claims the benefits under 35 U.S.C. §119(e) from U.S. Provisional Patent Application No. 60/124,275 entitled "A METHOD AND APPARATUS FOR PRESSURE WAVE SUPPRESSION AND FLY ROCK CONTROL IN SMALL-CHARGE BLASTING" filed on Mar. 11, 1999, which is incorporated by reference herein in its entirety.

FIELD OF THE INVENTION

The present invention is directed generally to methods and devices for small charge blasting of rock and other materials and specifically to methods and devices for controlling pressure wave emissions and/or flyrock generated by the small-charge blasting process.

BACKGROUND OF THE INVENTION

In civil excavation projects in urban environments, many restrictions are imposed on operators that substantially increase the operator's capital and operating costs. The operator must generally comply with strict requirements regarding not only the transportation, storage and use of explosives but also airblast, noise, and airborne flyrock particles. "Airblast" refers to pressure waves in air emanating from a rapid release of energy (e.g., a blast). Airblast noise is the audible part of the airblast energy spectrum, having frequencies in the range from 20 to 20,000 Hz. Airblast concussion is the inaudible part of the airblast energy spectrum, having a frequency content below 20 Hz. "Noise" refers to pressure waves in air generated by equipment other than the small charge blasting equipment, such as the drill during formation of one or more holes for small charge blasting and/or the impact breaker during removal of fractured material. "Flyrock" refers to rock particles thrown into the air by the rapid release of energy (e.g., blast). Flyrock may be in the form of a shower of small pieces at relatively high velocities (20 to 50 m/s typical), which typically originate from the collar region of the drill hole. Flyrock may also be in the form of larger pieces of rock at relatively low velocity (1 to 10 m/s typical), which typically originate in the mass of rock excavated from the crater formed by the blasting event.

Existing drill and blast methods may be inapplicable in many applications as a result of these restrictions, even though the blasting methods are the most cost effective method for the specific application. For example, small charge blasting which commonly has a lower seismic and airblast signature, cause less flyrock, and have lower operating costs compared to conventional drill and blast techniques, can nonetheless generate airblast, equipment noise, and/or flyrock levels that exceed the maximum permissible levels in many applications. "Small charge blasting" refers to any excavation method where relatively small amounts of an energetic substance (typically a few kilograms or less) are consumed for each hole in a rock fracturing sequence.

SUMMARY OF THE INVENTION

Objectives of the present invention include providing a drilling and blasting methodology for excavating rock, particularly hard rock, in airblast, noise, and/or flyrock restricted areas, such as urban settings, and providing a methodology and apparatus(es) for use with small-charge blasting techniques for controlling and/or suppressing airblast in airblast restricted areas, controlling and/or suppressing equipment noise in noise restricted areas, and/or for controlling and/or suppressing flyrock in flyrock restricted areas.

These and other objectives are addressed by the methodology and apparatuses of the present invention. In a first embodiment, a method is provided for selecting one or more pressure wave suppression devices for use with small-charge blasting of a material that is near a pressure wave (i.e., an airblast and/or noise) restricted area. The method broadly includes the steps of:

(a) determining one or more pressure wave level requirement(s) at corresponding selected distance(s) from the material to be broken;

(b) determining a corresponding unsuppressed pressure wave level(s) at each selected distance produced by the excavation equipment in the absence of a pressure wave suppression device;

(c) comparing the pressure wave level requirement(s) with the corresponding unsuppressed pressure wave level(s) to determine a desired amount of pressure wave suppression;

(d) comparing the desired amount(s) of pressure wave suppression at one or more distances from the material to be broken with an amount of pressure wave suppression for each of a plurality of pressure wave suppression devices; and (e) thereafter selecting one or more pressure wave suppression devices based on the comparing step (d) to produce the desired amount(s) of pressure wave suppression. As used herein, a "pressure wave level requirement" refers to the maximum permissible pressure wave emission levels and is often expressed as a maximum allowable pressure wave emission level at a specified distance from the blasting site (e.g., the location of the energetic substance used in the small charge blasting process). The method provides an operator with versatility in meeting the unique requirements of each job and a relatively low cost and simple excavation technique that complies with the often demanding requirements in pressure wave restricted areas.

The process is particularly applicable to small charge blasting techniques using controlled fracturing to break the material. Generally, controlled fracturing is performed by drilling a hole in the material to be broken, inserting a sealing member, which can be a stemming bar, a gas injector barrel, or other pressurizing device, into the drill hole, and releasing a pressurized working fluid rapidly into a portion of the drill hole, usually the bottom portion. "Sealing" refers to partial or total blockage of the hole to inhibit the escape of the fluid from the drill hole. "Sealing member" refers to any downhole device capable of sealing a pressurized working fluid in the bottom of a hole, including without limitation loosely consolidated or unconsolidated particles such as sand, gravel, rock fragments, and the like, and a solid material such as grout, a stemming bar, a gas injector barrel, and the like. The pressurized fluid is typically generated by combustion of a propellant or explosive source, by an electrical discharge into a conductive fluid, or by compression of the working fluid. The fractured material is thereafter removed from the face by an impact breaker and mucking equipment. Because of the relatively low weight of the energetic substance used to generate the working fluid and the relatively low pressure wave and flyrock emissions, equipment and personnel commonly remain in the area of the hole during the small charge blast.

The plurality of pressure wave suppression devices and their performance capabilities can be listed in the form of a menu from which any number of appropriate devices can be selected. The plurality of pressure wave suppression devices preferably includes at least one of, more preferably at least two of, and even more preferably at least three of:

(i) a downhole pressure wave suppression device located in a hole in the material for directing flow of the working fluid through one or more nonlinear pathways and/or for contacting at least a portion of the working fluid with a thermal energy absorbing material having a plurality of heat transfer surfaces, and/or for attenuating the noise generated by downhole equipment (e.g., a drill), (ii) a collar pressure wave suppression device located at or near the opening of the drill hole in communication with the drill hole for directing flow of the working fluid through one or more nonlinear pathways, for contacting at least a portion of the working fluid with a thermal energy absorbing material having a plurality of heat transfer surfaces, and/or for attenuating the noise generated by the downhole equipment, (iii) a mat positioned on the surface of the material to be broken around the hole opening for directing flow of the working fluid through one or more nonlinear pathways in the mat and/or for absorbing thermal energy from the working fluid by contacting the working fluid with a plurality of heat transfer surfaces, (iv) an enclosure substantially surrounding the hole opening for containing the equipment noise and/or working fluid (i.e., the pressure waves) and impeding the discharge of the noise and/or working fluid into the ambient atmosphere, (v) a barrier located between the hole opening and the pressure wave restricted area for absorbing and/or deflecting at least a portion of the pressure wave energy, and (vi) a plurality of atomized liquid droplets (preferably having a droplet size ranging from about 0.01 to about 0.1 mm) suspended in the air adjacent to the surface of the material during the blast to absorb thermal energy from the working fluid. The plurality of devices includes not only devices capable of resisting the high gas pressures in close proximity to the small-charge blast but also devices capable of resisting only relatively low gas pressures further away from the blast. Many of the devices can not only suppress pressure wave energy but also reduce or eliminate flyrock.

The determining step (a) can include a number of substeps to determine the pressure wave level requirement. By way of example, the substeps can include:

determining operator pressure wave requirement(s) at one or more selected distances from the material to be broken (i.e., the "operator pressure wave requirement" refers to pressure wave restrictions that are generally applied by the operator and are independent of the specific job, such as mandated by the operator to protect personnel and equipment);

determining job pressure wave requirement(s) at one or more selected distance(s) from the material to be broken (i.e., the "job pressure wave requirement" refers to pressure wave restrictions that are unique to the specific job, such as imposed by regulatory authorities or by the surroundings of the job, e.g., nearby structures or thoroughfares); and comparing the operator pressure wave requirement with the job pressure wave requirement with the more restrictive of the two (i.e., the requirement mandating a greater degree of pressure wave attention) being the pressure wave level requirement.

The operator pressure wave requirement(s) in small charge blasting typically includes a machine pressure wave requirement(s) and/or a personnel pressure wave requirements(s). In small charge blasting, the equipment and personnel commonly remain at or near the hole during the blast. Because of the small charge used in the blast, complete excavation of the blasting site during blasting, as normally is the case in conventional large charge blasting, is often unnecessary and even undesirable for reasons of productivity. For these reasons, the small charge blasting operator commonly formulates requirements unique to small charge blasting and independent of the specific job to protect equipment from pressure wave emissions of the blast ("the machine pressure wave requirement") and from flyrock ("the machine flyrock distance requirement") and personnel from pressure wave emissions of the blast ("the personnel pressure wave requirement") and from flyrock ("the personnel flyrock distance requirement").

The unsuppressed pressure wave levels at the selected distance from the material to be broken are commonly determined by numerous field measurements.

Once the unsuppressed pressure wave level and the pertinent pressure wave level requirement are known, a sufficient number of pressure wave suppression devices are selected to realize the desired amount of pressure wave suppression. Each of the pressure wave suppression devices in the menu will yield a specific amount of pressure wave suppression, usually determined and quantified by field measurements. The appropriate pressure wave suppression devices for a given application are commonly selected based not only on the desired pressure wave level reduction but also on the requirements of the job, cost considerations, and the like.

The process can include various substeps. For example, step (a) can include the substep of determining at least two of a job pressure wave requirement, a machine pressure wave requirement, and a personnel pressure wave requirement. In that event, step (b) includes the substep of determining a corresponding unsuppressed pressure wave level for each of the at least two of a job pressure wave requirement, a machine pressure wave requirement, and a personnel pressure wave requirement at a corresponding selected distance from at least a portion of the material to be broken and step (c) the substep of comparing the at least two of a job pressure wave requirement, a machine pressure wave requirement, and a personnel pressure wave requirement with the corresponding unsuppressed pressure wave level to determine a corresponding degree of pressure wave suppression. Steps (d) and (e) are thereafter repeated for each of the corresponding degrees of pressure wave suppression to verify that the selected pressure wave suppression devices are sufficient to comply with the at least two of the job pressure wave requirement, the machine pressure wave requirement, and the personnel pressure wave requirement.

The above-described steps are commonly repeated for each step of the process (and each piece of equipment) that generates pressure waves. For example, the above-noted steps are typically repeated for the step of drilling the hole impact breaking of the fractured rock, and/or mucking of the fractured rock.

Commonly, a number of the pressure wave suppression devices selected in the process (e.g., mats and barriers) remain in place during the repeated drilling and small charge blasting sequences. This is so because only one or at most a few holes are shot at any one time because the small charge blasting machine can only seal one hole at a time. In contrast in conventional large charge blasting a large number of holes are simultaneously shot and the pressure wave suppression devices are thereafter removed to remove fractured material and drill new holes and repositioned before the next blasting cycle.

To control flyrock, the method can include additional steps. Specifically, the steps include:

determining at least two of (a) a job flyrock distance requirement (i.e., the "job flyrock distance requirement" refers to flyrock distance restrictions that are unique to the specific job, such as imposed by regulatory authorities or by the surroundings of the job, e.g., nearby structures or thoroughfares), (b) the personnel flyrock distance requirement, and (c) the machine flyrock distance requirement;

comparing the at least two of the job flyrock distance requirement, the personnel flyrock distance requirement, and the machine flyrock distance requirement to determine a flyrock distance requirement; and comparing the flyrock distance requirement with an uncontrolled (or unsuppressed) flyrock distance(s) to determine whether protection against flyrock is required. "Unsuppressed flyrock distance" refers to the probable flight distance of flyrock from the hole. If the flyrock distance requirement is more restrictive than the unsuppressed flyrock distance(s), the operator should consider the need for flyrock protection in selecting a device(s) from among the various devices in the menu.

In a second embodiment of the present invention, a pressure wave suppression device is provided that has at least one nonlinear pathway extending therethrough for channeling the flow of the gas released by the energetic material. The nonlinear pathway can remove energy from the airblast and thereby facilitate pressure wave suppression. Typically, the device will have a plurality of nonlinear (or tortuous) pathways of different lengths to achieve suppression. The device can include, for example, a plurality of baffles and dead end chambers that may be separated by an attenuation material (e.g., a fibrous porous filament material such as metal (e.g., copper, steel, etc.) wool, packed metal (e.g., copper, steel, etc.) balls or ball bearings, a series of perforated mats stacked on top of the other and having different sized and/or misaligned perforations. The device can be located at and/or around the hole opening and/or in the hole itself and generally substantially surrounds the outer perimeter of the sealing member. The device is particularly effective in airblast suppression.

In another embodiment of the present invention, a pressure wave and flyrock suppression device is provided that is an enclosure substantially surrounding and enclosing the opening of the hole. For pressure wave suppression, the enclosure interior can have a pressure wave layer for absorbing, dissipating or reflecting the pressure waves and an impact resistant layer located on the interior surface of the enclosure (interiorly of the impact resistant layer) for deflecting flyrock. The enclosure is sufficiently large to contain the sealing member for small charge blasting and a drill and/or impact breaker for more effective pressure wave suppression. The enclosure can be a flexible canopy, a rigid box-like structure, or combination of rigid and flexible elements. The enclosure encloses a sufficient volume such that the gas pressure within the enclosure is controlled to an average overpressure of preferably no more than about 15 KPa during formation and propagation of a fracture from the hole. The volume of the enclosure preferably is at least about 4 cubic meters and more preferably ranges from about 4 to about 100 cubic meters. The pressure wave layer can be any suitable material including rubber, canvas, fiberglass mesh, industrial conveyor belt or commercially available acoustic material and the impact resistant layer can be any suitable material including a perforated steel plate, steel mesh, fiberglass mesh, industrial conveyor belt, heavy canvas sheet, composite materials such as "KEVLAR" or impact resistant plastics. For additional pressure wave suppression the enclosure can have a plurality of leakage vents for discharging the gas released by the energetic material into the ambient atmosphere at a controlled rate.

Finally, another embodiment of the present invention is directed to a method for employing blasting mats for pressure wave and/or flyrock suppression to efficiently and inexpensively perform small charge blasting. The steps are:

(a) positioning a blasting mat on at least a portion of the material to be broken;

(b) drilling or otherwise forming a hole in the at least a portion of the material through the blasting mat;

(c) inserting an energetic substance (and/or sealing member) through the blasting mat and into the hole; and (d) releasing energy from the energetic substance in the hole to initiate and propagate a fracture from the hole. The fracture can be a penetrating cone fracture or another type of controlled fracture.

The drilling step (b) is typically performed by forming a hole in the mat and inserting at least a portion of the drill through the hole in the mat. The hole can be formed in the mat by cutting through the mat or by deforming a pre-existing opening in the mat. The latter approach is used where the blasting mat is composed of one or more flexible mats of a mesh material. The flexible mats preferably have differing mesh sizes to facilitate removing and/or dispersing of energy from the pressure wave and an upper layer above the perforated mesh material that will inhibit the release of the pressure waves into the environment and thereby force the pressure waves to negotiate the tortuous passages through the mats to be released from the outer perimeter of the mats.

DETAILED DESCRIPTION

Figure 1:
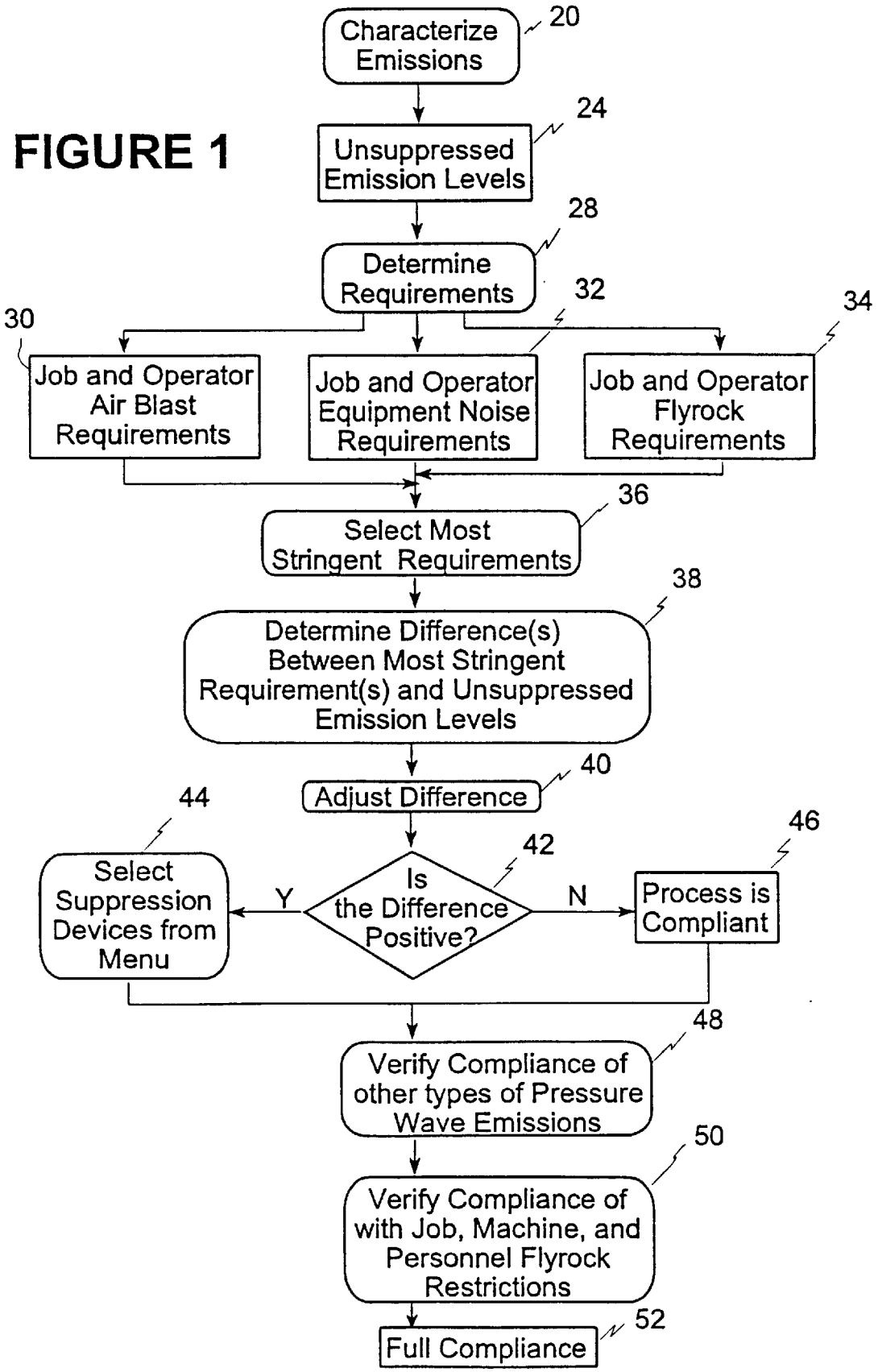
FIG. 1 is a decision tree that can used by a small-charge blasting estimator and/or operator to select the airblast suppression, noise abatement, and flyrock control devices appropriate to a particular excavation job.

The Selection of an Appropriate Pressure Wave and Flyrock Suppression Device Referring to FIG. 1, the first step 20 in selecting appropriate pressure wave and flyrock suppression device(s) is to characterize the unsuppressed pressure wave and flyrock emissions 24 of the small charge excavation process. For example, the drilling noise characteristics of a particular drilling device, the airblast and fly rock characteristics of a particular small-charge blasting method, and the noise characteristics of a particular impact breaker are generally determined by field measurements.

The characteristics of both equipment noise and airblast can be characterized by a peak amplitude versus distance curve and an energy amplitude versus frequency curve. The former shows the decay of peak amplitude with distance and the latter shows at which frequencies the energy of the pressure waves are concentrated.

The unsuppressed pressure wave amplitude for the small charge blasting process at a given distance from the hole to be drilled/blasted is often a function of the energy of the small charge blast. In the case of propellant or explosive based small charge blasting, the dependence of airblast on distance may be expressed in terms of propellant or explosive weight used (since their energy densities are usually all in the range of about 3.5 to about 4.5 MJ/kg). The functional relationship is usually plotted on a log-log plot showing either pressure or decibels as a function of scaled distance where scaled distance is the actual distance divided by the cube root of the charge energy or weight.

Figure 2:
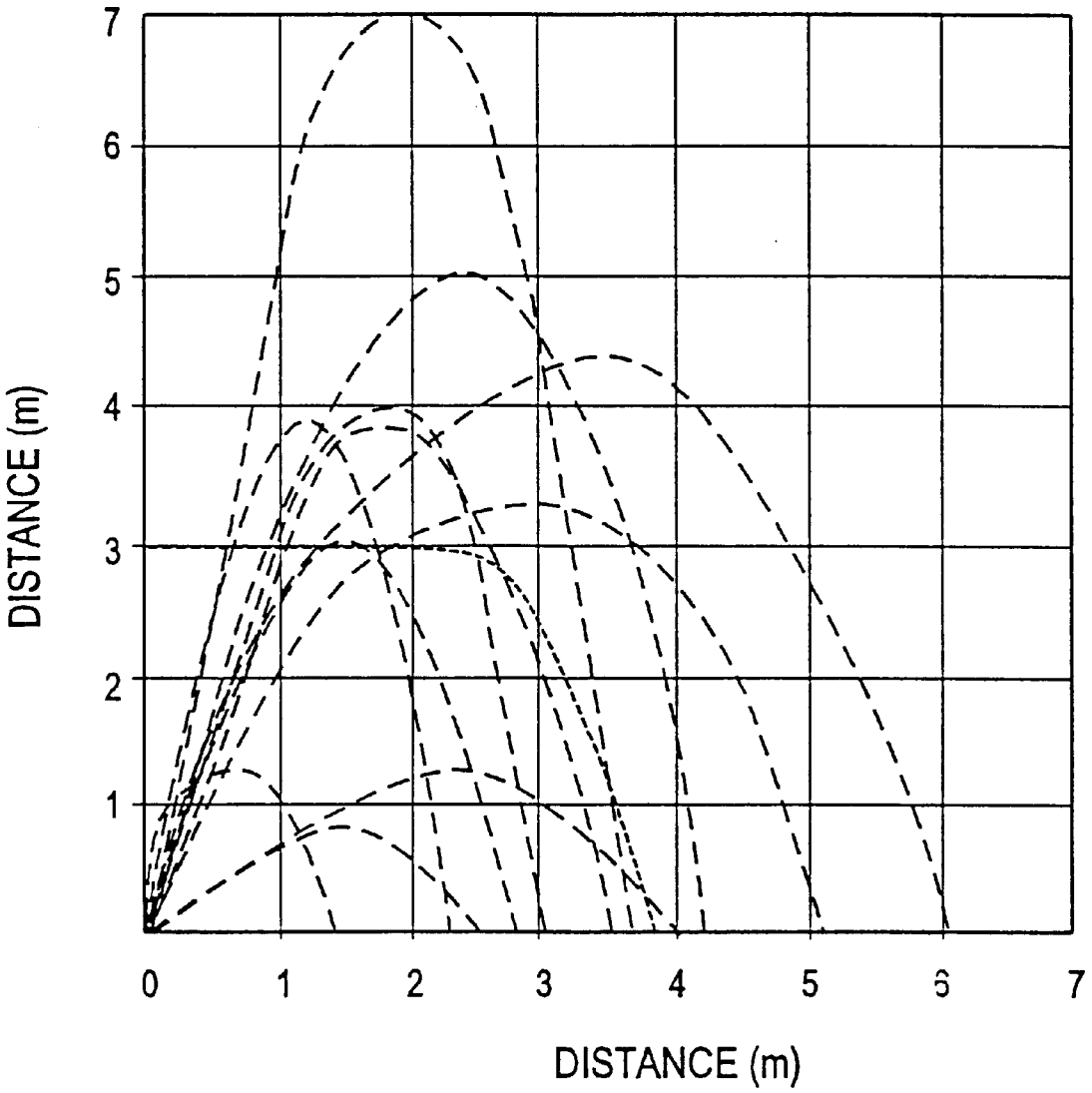
FIG. 2 is an exemplary plot of flyrock trajectories in both the vertical and horizontal directions.

The characteristics of flyrock can be characterized statistically by a probability distribution function that relates charge weight and rock type with the distribution of flyrock at varying distances from the hole or by a plot such as that in FIG. 2 generated for a specific charge weight and rock type.

In box 28, the job and operator pressure wave requirements (e.g., job and operator airblast requirements 30 and/or job and operator equipment noise requirements 32, if different), job and operator flyrock requirements 34, and any other pertinent pressure wave and flyrock requirements are determined.

Each excavation job and particularly urban excavation work, has a number of unique job pressure wave restrictions on air-blast and noise. These may be simple restrictions such as a noise level not to be exceeded at a certain distance from the job site. The restrictions may be more elaborate and contain not-to-exceed levels for pulsed, intermittent and continuous air/blast noise levels at several distances and under certain atmospheric conditions. Generally the pressure wave restrictions are expressed as the peak pressure wave amplitude at one or more distances from the work area or shot point and often will specify the range of frequencies where the peak amplitude requirements apply.

The operator pressure wave requirement(s) commonly include the personnel and machine pressure wave requirements. For example, the operator might have a near-field pressure wave limit imposed as a safety measure to comply with the operating company's internal requirements. In complying with this, the operator may have to add additional pressure wave suppression devices.

After determining all of the pertinent pressure wave specifications, the operator selects 36 the most stringent requirement(s) as the requirement(s) to be complied with. Commonly, the most stringent pressure wave requirement(s) is the requirement(s) that mandates the lowest pressure wave emissions, and the most stringent flyrock distance requirement(s) is the requirement(s) that mandates the lowest flyrock trajectory distance from the jobsite.

In some cases, the pressure wave requirements for airblast will be different from the pressure wave requirements for equipment noise. In such cases, the most stringent pressure wave requirement(s) is determined for each type of pressure wave emissions.

Next, the operator determines 38 the difference between the unsuppressed pressure wave emissions and the most stringent pressure wave requirement(s).

Because airblast requirements are typically more demanding than noise and flyrock requirements, the process first focuses on selecting appropriate pressure wave devices for suppressing airblast energy followed by determinations whether additional devices are required for attenuating equipment noise and/or flyrock. As will be appreciated, in some applications equipment noise or flyrock may be the more demanding requirement and the process would be reconfigured to consider that requirement first followed by verification that the devices chosen also comply with the less restrictive requirements.

The difference of step 38 (or the unsuppressed pressure wave emissions) may be adjusted 40 upwards (or sometimes downwards) based on safety factors, atmospheric conditions, and other factors. The difference (or the unsuppressed pressure wave emissions) may be increased by a suitable safety factor to ensure compliance with pertinent regulations. The difference may be adjusted based on the forecasted atmospheric conditions received from an outside service. Such special conditions might include strong atmospheric temperature inversions, heavy low cloud cover or heavy fog. These type of atmospheric conditions can reflect noise and airblast energy initially radiated upwards back down toward the ground and may even focus noise and airblast energy in a specific location quite far from the work site. The estimator/operator may have access to services that provide such information or he may have to use his judgement.

After suitable adjustments of the difference between the unsuppressed pressure wave emissions and the pressure wave requirement, the operator determines 42 whether the difference is positive or negative. If the difference is negative or zero, the small charge process is airblast compliant 1008 without the need for airblast pressure wave attenuation devices. If the difference is positive (i.e., the unsuppressed pressure wave levels exceed the pressure wave level requirement), the operator in box 44 selects a sufficient number of cost effective pressure wave suppression devices from a menu of such devices to attenuate the difference. If possible, the operator selects the combination of devices that minimizes capital and operating costs, controls equipment noise to meet the job pressure wave specification, and controls flyrock to meet the job flyrock specification. For example, the adjusted differences may be 40 to 50 dB at a first distance from the jobsite and 60 to 70 dB at a second distance from the jobsite with the first distance being less than the second distance.

The menu must characterize the devices at least in terms of the amount of pressure wave attenuation they provide at specified distances from the drill hole/jobsite. This is usually expressed in terms of dB of attenuation at the specified distance. Most well designed passive devices will provide in the range of about 10 to 20 dB of pressure wave attenuation at a specified distance relatively close to the hole/jobsite. Some devices will of course provide an amount of attenuation that is indirectly proportional to the distance from the jobsite. The pressure wave attenuations determined for each pressure wave suppression device may contain a safety factor (i.e., be stated conservatively) to ensure that the devices will suppress the stated amounts of pressure wave energy. An example of such a menu might be:

| PRESSURE WAVE SUPPRESSION DEVICE | AMOUNT OF PRESSURE WAVE ATTENUATION (dB) |
|---|---|
| Down Hole Baffle Device | 20 |
| Collar Shroud | 20 |
| Ground Mats | 10 |
| Atomized Fluid Spray | 10 |
| Flexibie Rig Canopy | 15 |
| Rigid Rig Enclosure | 20 |
| Wall Sound Absorbing Barriers (for example, liners for shafts) | 10 |
| Stand Alone Sound Barriers | 5 |

Referring to FIG. 1, once the pertinent pressure wave suppression requirements have been met for airblast, the operator must verify 48 that equipment noise and other types of pressure wave emissions do not exceed the pertinent pressure wave specification(s) when the devices selected above are in place. This will require the operator to determine whether unsuppressed equipment noise (e.g., noise from a drill or impact breaker) or other types of pressure wave emissions exceeds, for the specific type of pressure waves, the more stringent of the job pressure wave and operator pressure wave requirements. If not, additional pressure wave attenuation is unnecessary. If so and if the devices are inadequate to suppress the type of pressure waves, a second menu of pressure wave attenuation devices, which is similar to (but typically not the same as) the table described above, is reviewed and additional devices selected to suppress the type of pressure waves.

Although many pressure wave suppression devices can suppress both equipment noise and airblast, some devices will provide differing degrees of attenuation for airblast and equipment noise. For example, some devices will have higher attenuation of airblast and have little or no attenuation of equipment noise. The downhole baffle device and ground mats attenuate at most only a small fraction of the drilling noise while a collar shroud, flexible rig canopy, rigid rig enclosure, wall sound absorbing barriers, and stand alone sound barriers are effective in attenuating equipment noise such as drilling noise.

Other devices that are able to suppress the type of pressure waves but not airblast energy may not be listed in the menu. For example, devices not listed in the menu above include, additional muffling for engines; a noise suppression collar for the rock drill; and a separate noise abatement enclosure for an impact hammer.

Once the pressure wave requirements have been met for airblast, equipment noise, and/or other types of pressure wave emissions, the operator must verify 50 that flyrock control requirements are also met. The flyrock verification step 50 requires the operator to compare the more stringent of the personnel, machine, and job flyrock distance requirements with the unsuppressed flyrock distance(s) to determine if flyrock protection is necessary. If the pertinent flyrock distance requirement(s) is less than the unsuppressed flyrock distance(s), flyrock control equipment is required. In that event, the devices selected above are analyzed to determine whether they are able to suppress flyrock and comply with the requirements, If not, yet another menu of flyrock control devices is considered to select additional devices to suppress the flyrock. Usually the use of ground mats, collar shrouds and barriers will be sufficient to meet flyrock control requirements. However, if only barriers are required to achieve the job and operator pressure wave requirements, then additional devices such as ground mats or a collar shroud may be required to achieve adequate flyrock control. The operator may also require some close-in flyrock control to protect the excavating machine or some other piece of equipment used at or near the work face.

After applying the above-noted steps, the operator should be in full compliance 52 with job and operator pressure wave and flyrock requirements and all pressure wave requirements.

As will be appreciated, the above-described process steps may vary somewhat depending on the job type (surface excavation, basement excavation, partially enclosed excavation, shaft, tunnel, drift or cavern). The process steps were described generally with reference to pressure wave and flyrock restrictions in an urban environment.

Down Hole Pressure Wave Suppression Devices

Down hole pressure wave suppression devices are aimed at intercepting and controlling the airblast adjacent to the source of the small charge blast event in the drill hole and around the barrel or sealing member. In one configuration, rigid impact resistant annular housing fits around and is connected to the sealing member and functions like a silencer on a gun. The housing is substantially open at the both the downhole and uphole ends, and has a series of internal baffle plates and/or dead-end chambers and/or attenuation material that cause the pressurized working fluid that leaks up the drill hole to negotiate a series of separate paths of unequal length (nonlinear pathways). In this way, the coherence of the airblast that exits the silencer is eroded such that the peak pressure of the airblast is diminished and its pulse width is lengthened, resulting in a lower amplitude, lower frequency air-blast than would be otherwise generated. The baffles and/or dead-end chambers and attenuation material will also increase the surface area over which the energetic working fluid must flow thereby enhancing heat transfer from the working fluid to the baffle plates. This acts to de-energize the pressurized working fluid that leaks up the drill hole which, in turn, acts to reduce the peak amplitude and pulse width of the resultant airblast wave.

Figure 3:
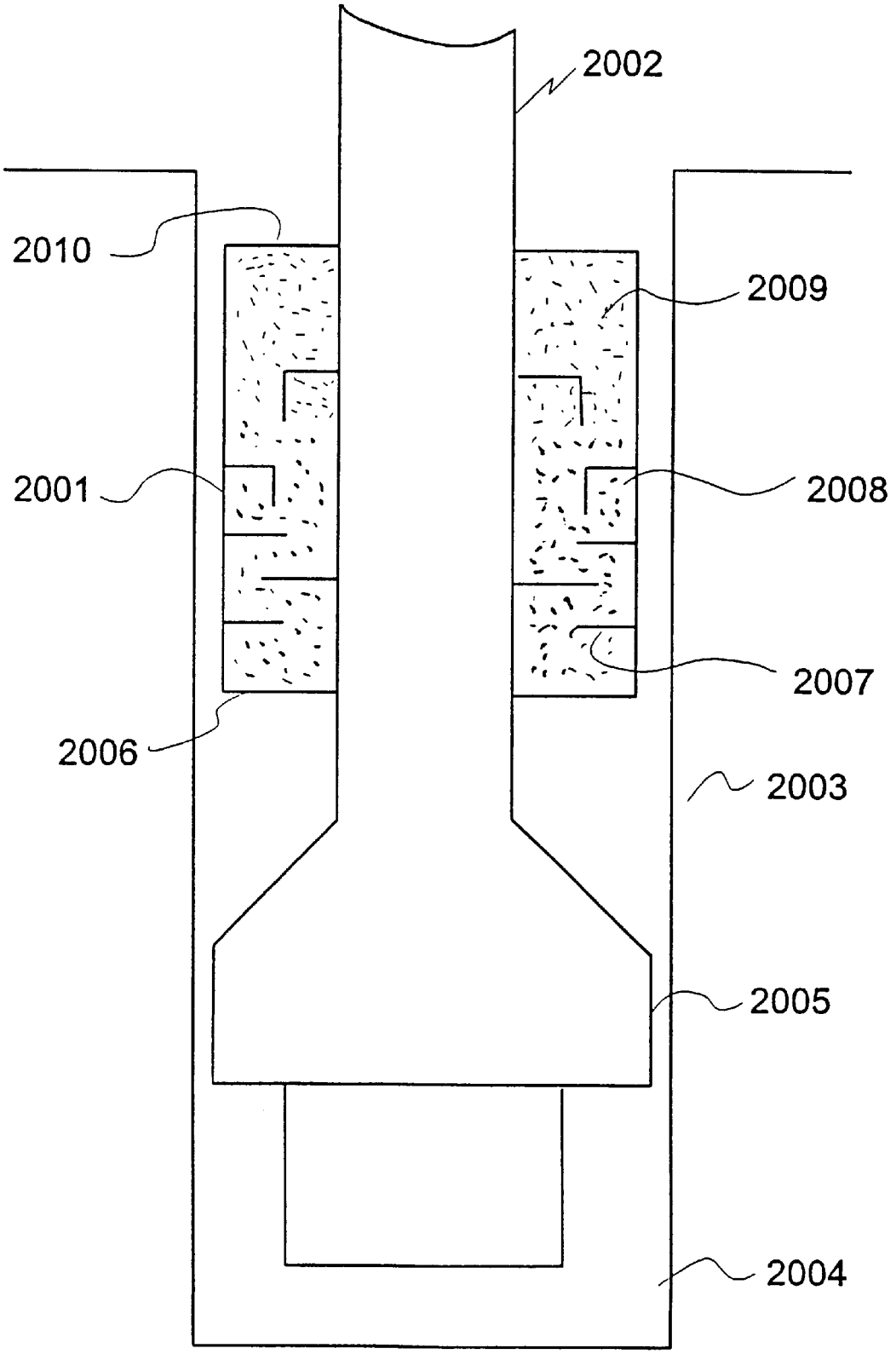
FIG. 3 is a cutaway side view of a sealing member which includes a series of high-pressure baffles for disrupting and de-energizing the flow of high pressure working fluid in the drill hole.

An example of such a down hole airblast silencer device is shown in FIG. 3. The silencer 2001 is firmly connected to the sealing member 2002 which is inserted into a drill hole 2003. The small-charge blasting agent (or working fluid) pressurizes the bottom portion 2004 of the drill hole 2003. The sealing member 2002 seals the bottom portion 2004 by a sealing surface or other sealing device 2005 near the hole bottom. The silencer 2001 is located uphole of the sealing surface 2005 and substantially fills the cross-sectional area of the hole. The down hole end 2006 of the silencer 2001 is open or perforated to allow the flow of high-pressure gases to enter. The inside of the silencer includes a plurality of baffles 2007, a plurality of dead-end chambers 2008 and/or attenuation material 2009. The uphole end 2010 of the silencer 2001 is also open or perforated to allow the high-pressure gases to escape in a less coherent and less energetic state than they entered. The gas pressures that the silencer device is exposed to are typically in the range of about 5,000 to about 50,000 psi.

Collar Pressure Wave and Flyrock Suppression Devices

Collar pressure wave and flyrock suppression devices intercept and control the energetic working fluid that escapes from the collar (i.e., opening area) of the drill hole and/or stop small pieces of relatively high velocity flyrock that originate from the collar of the drill hole. The collar pressure wave suppression device can have the same features as the downhole silencer device except that the collar devices are commonly much larger, have a larger internal volume and are positioned outside the drill hole over the collar of the drill hole instead of inside the hole.

Figure 5A:
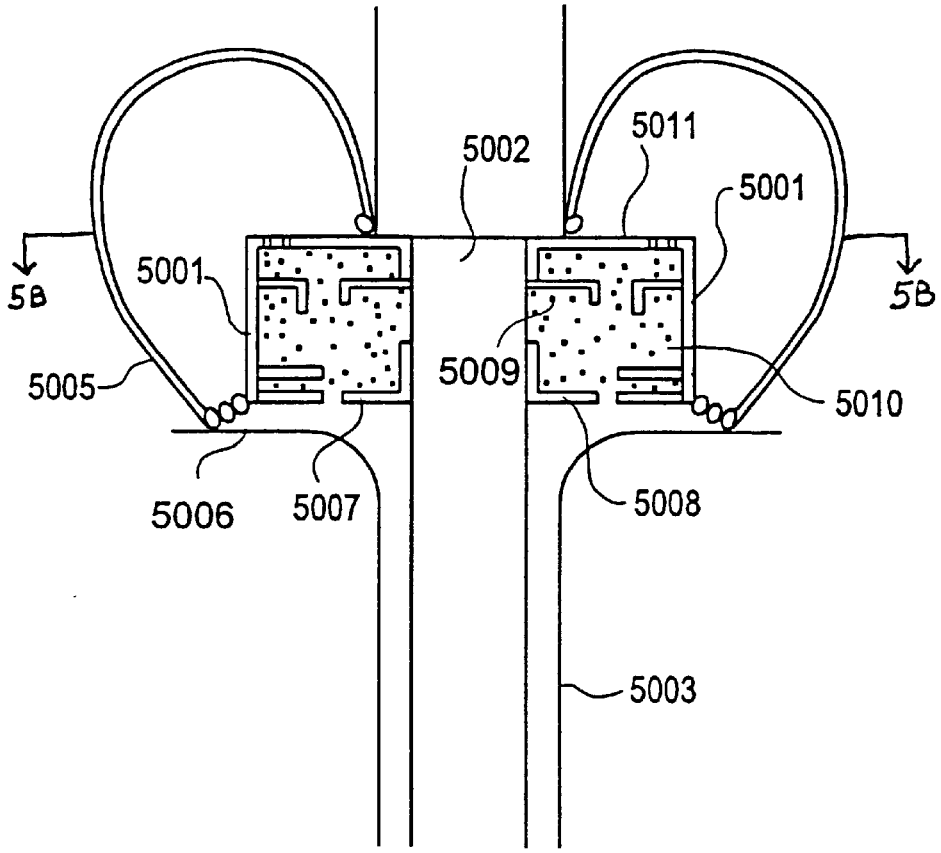
FIGS. 5A and 5B respectively are a cutaway side view taken along line 5A—5A of FIG. 5B and a cutaway plan view taken along line 5B—5B of FIG. 5A of a collar shroud installed around the collar of a drill hole and secured by the stemming or gas-injecting means.
Figure 5B:
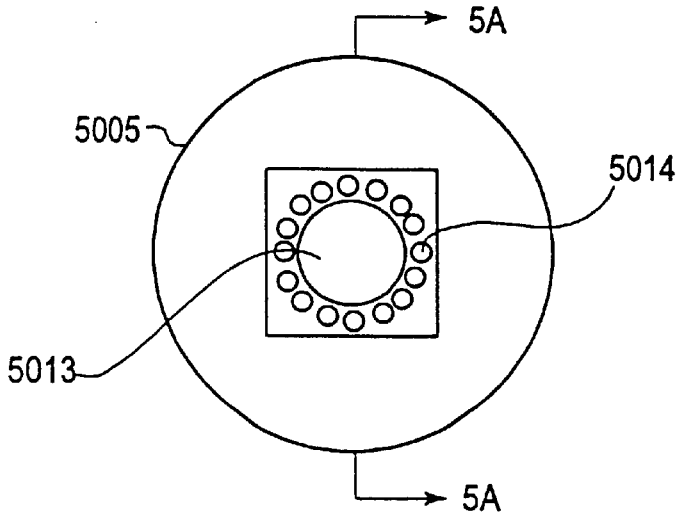

An example of a collar shroud device for airblast suppression is shown in FIG. 5A. The collar shroud 5001 is typically rigidly connected to the proximal end of the sealing member 5002 such that when the sealing member 5002 is inserted in a drill hole 5003, the body of the collar shroud 5001 and a flexible skirt 5005 contact the region around the collar of the drill hole 5006 to form a rough seal. The down hole end 5007 of the collar shroud 5001 is open or perforated to allow the flow of high-pressure gases to enter from the hole. The inside of the collar shroud includes a plurality of baffles 5008, a plurality of dead-end chambers 5009 and/or the attenuation material 5010 which together form nonlinear pathways of different lengths and a large surface area for heat transfer. The uphole end 5011 of the collar shroud 5001 is also open or perforated to allow the high-pressure gases to escape in a less coherent and less energetic state than they entered. The heavy flexible outer skirt 5005 further contains the escaping gases. This outer flexible skirt 5005 may be made from flexible air conditioning duct material, heavy canvas or industrial conveyor belt, and the like. This outer flexible skirt 5005 may or may not be included as part of the collar shroud 5001 and may be attached to the uphole end 5011 of the collar shroud 5001 and the downhole end 5007 by any number of means (such as by a heavy chain as shown)or directly to the sealing member. The collar shroud 5001 is shown in plan view in FIG. 5B which shows the hole for the sealing member 5013, perforations 5014 on the uphole end 5011 and the flexible outer skirt 5005. The collar shroud 5001 shown in plan view 5015 may be either round, rectangular, or any other shape.

Figure 5C:
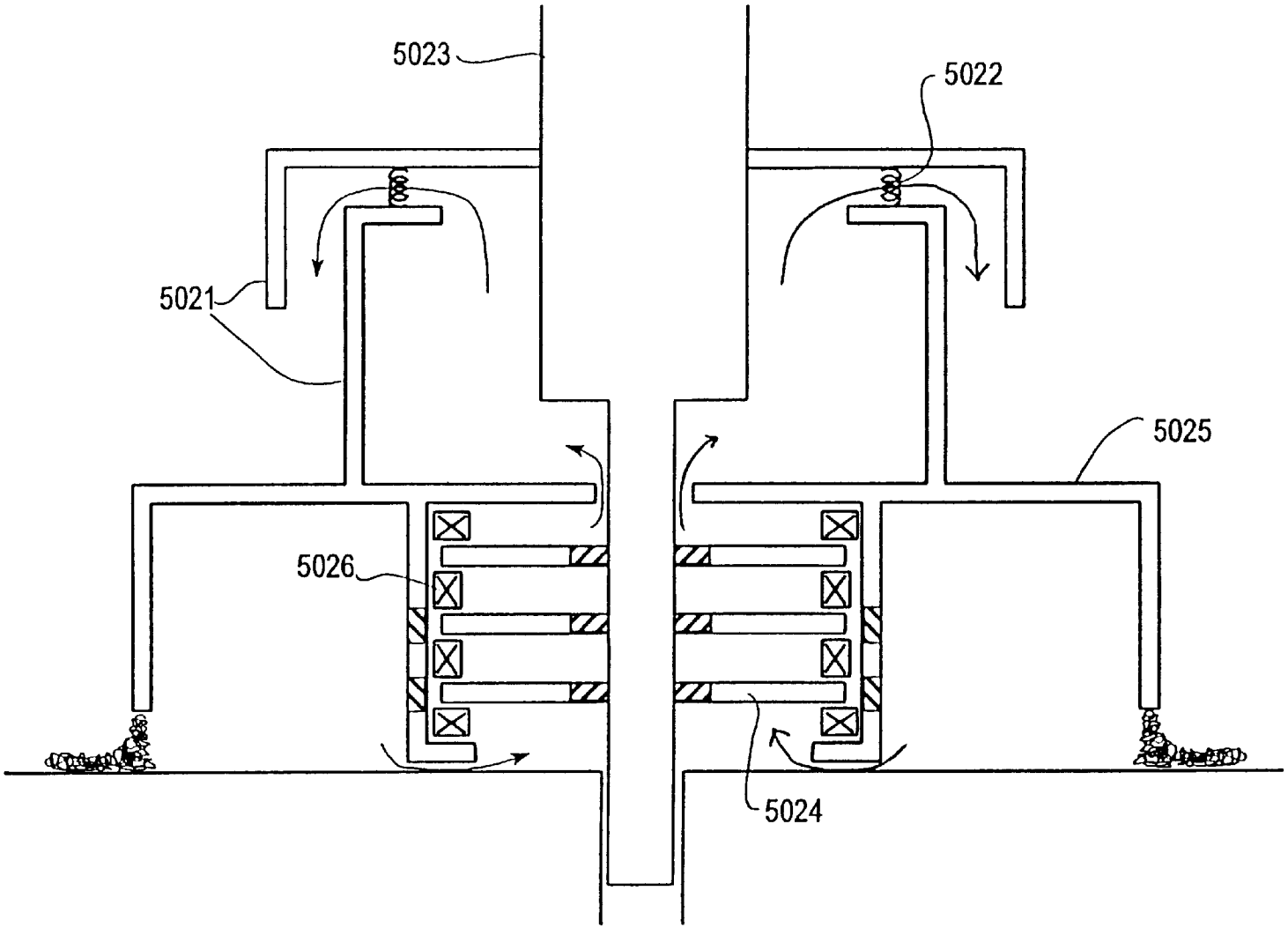
FIG. 5C is a cutaway side view of an alternative embodiment of a collar shroud decoupled from the stemming or gas injecting device.

An alternate embodiment of a collar shroud device is shown in FIG. 5C. This embodiment shows a collar shroud 5021 that is decoupled from the sealing member 5023 by any suitable device 5022, such as a spring. It also shows internal baffles 5024 that are shock-isolated from the main body 5025 by rubber or shock isolation elements 5026. The nonlinear escape path of the working fluid is shown by arrows.

Since the rigid collar shroud must contain substantially undiluted but expanded energetic working fluid, it must be of robust construction. The gas pressures are in the range of about 1,000 to about 5,000 psi. The internal volume of the collar shroud is preferably in the range of about 0.03 $m^3$ to 2 $m^3$, more preferably in the range of about 0.06 $m^3$ to 1 $m^3$, and most preferably in the range of about 0.1 $m^3$ to 0.5 $m^3$.

Figure 6:
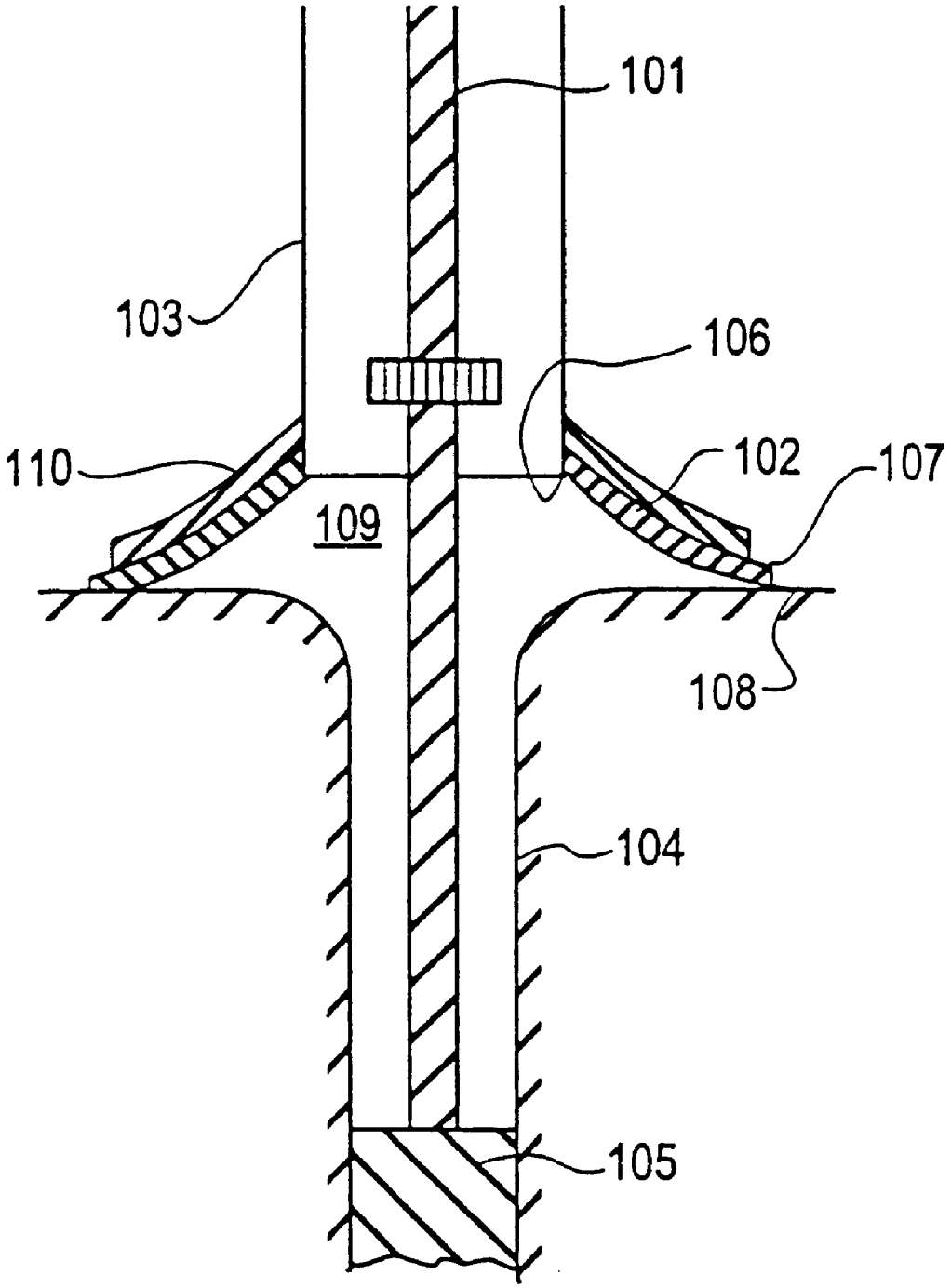
FIG. 6 is a cutaway side view of an alternative embodiment of a collar shroud for use with a drill.

FIG. 6 depicts a collar shroud for suppressing pressure waves generated during the drilling of the hole. The drill has a drill steel that is decoupled from the collar shroud 102 so that the drill steel may rotate freely from the shroud 102. This shroud 102 is designed to substantially attenuate the noise emanating from the drill hole 104 as a result of the percussive hammering of the rock by the drill bit 105 at the downhole end of the drill steal. The shroud, like the other collar devices discussed above, surrounds and encloses the hole from the exterior environment. The proximal end 106 of the device is rigid and made from a suitable high strength material such as steel plate. The distal end 107 of the device is a flexible shroud such that when the drill slide 103 is positioned next to the rock face 108 for drilling, the flexible end 107 can conform to the rock face 108 to seal the pressure wave emissions in the shrouded area 109 and thereby impede the release of or attenuate the pressure waves in the exterior environment. The flexible end 107 may be made from a deformable material such as a heavy industrial plastic, rubber, canvas and the like. The flexible end 107 will also allow drilling fluids (water and air) and rock dust to escape through the rough seal formed with the rock face 108. The outside of the noise suppression device may be further covered with one or more additional layers 110 of acoustic material such as heavy industrial plastic, rubber, canvas or other commercially available acoustic materials. Noise from the drill motor piston hammering on the proximal end of the drill steel can be suppressed by wrapping the drill motor and proximal end of the drill steel with a noise absorbing material such as a heavy rubber sheath.

A collar shroud can also be used only for intercepting and controlling small, higher velocity flyrock originating in the drill hole or at the collar of the drill hole used for the small charge blast. The collar of the drill hole, in particular, is often the source of smaller, higher velocity flyrock.

If the collar shroud is used only for flyrock control, its internal construction may be simplified by removing the internal baffles, dead-end chambers and internal attenuation material. The flyrock will be substantially stopped by the bottom plate and flexible outer skirt.

Figure 4:
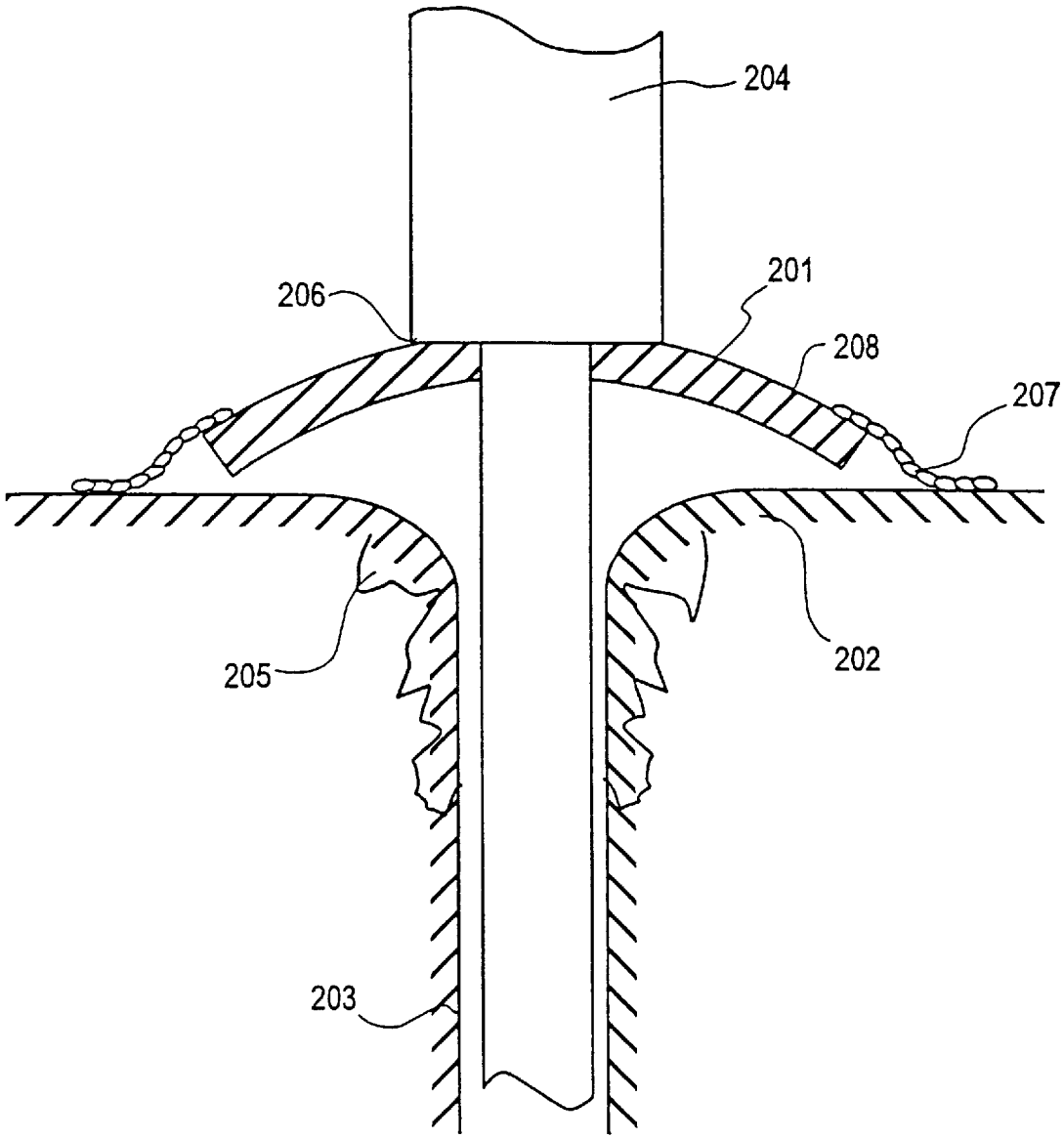
FIG. 4 is a cutaway cross-sectional view of a device for intercepting flyrock that originates from the collar region of a drill hole.

An exemplary flyrock control device is depicted in FIG. 4. FIG. 4 shows a cross-sectional view of a collar flyrock suppression shroud 201 positioned around and enclosing the collar 202 of the hole 203 for intercepting flyrock that originates from the collar region of the drill hole during small-charge blasting. A sealing member 204 is shown inserted into a drill hole 203 in firing position. Since some or all of the gases generated in the drill hole when the gas-generating device 204 is fired can escape up the drill hole 203, there is a strong potential for these gases to accelerate at high velocities broken or partially broken rock 205 in the collar region 202. The collar shroud 201 is solidly attached at its proximal end 206 to the sealing member 204 such that when the sealing member 204 is positioned in the drill hole for firing, the shroud 201 substantially blocks the line-of-flight of the flyrock that would originate in the collar region 202 of the drill hole 203. The flyrock shroud 201 may be made from a heavy impact resistant material such as steel, impact resistant plastics or composite materials, and the like. The shape of the flyrock shroud 201 may be convex as shown or in the shape of a cylindrical housing with its open end facing towards the entrance of the drill hole 203. For shooting holes drilled vertically into the rock, a shroud of mesh or chain links 207 or another deformable impact resistant material may be attached to the distal end 208 of the flyrock shroud 201 so as to further intercept flyrock that is accelerated laterally.

Ground Pressure Wave and Flyrock Suppression Devices

Ground pressure wave and flyrock suppression devices intercept and control the air-blast that escapes from fissures or fractures existing or created around the working face centered on the drill hole used for the small charge blast. A series of perforated mats are laid on top of each other over an area around the hole collar. The perforations in the adjacent, stacked mats are of differing sizes and/or are misaligned to form a labyrinth of gas passageways. For pressure wave suppression (but not for flyrock suppression alone), the mats are covered by a mat that is substantially impermeable to the flow of gas to force the working fluid through a labyrinth formed by the overlapping and interlinked meshes and/or perforations. The labyrinth forces the pressurized working fluid to negotiate a series of intricate passage ways of differing lengths and de-energizes the pressurized fluid by forcing the fluid to contact a large surface area to create conditions for significant heat transfer to the mesh. The gas pressures that this apparatus is exposed to are typically in the range of about 1,000 to about 10,000 psi.

One of the principal features of this embodiment is that it can be set in place and used without moving for several or many shots. One of the advantages of the mesh structure is that a hole for inserting the sealing member or drill can be readily formed by simply deforming the mesh to create a suitable insertion hole.

Figure 7A:
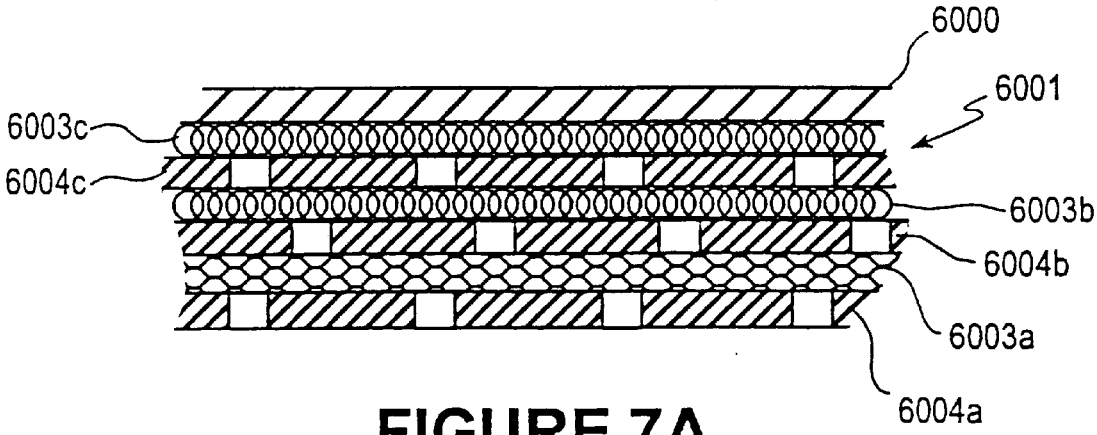
FIGS. 7A and 7B are respectively a cutaway side view taken along line 7A—7A of FIG. 7B and plan view of a ground shroud installed such that several shots can be fired before the shroud is moved.
Figure 7B:
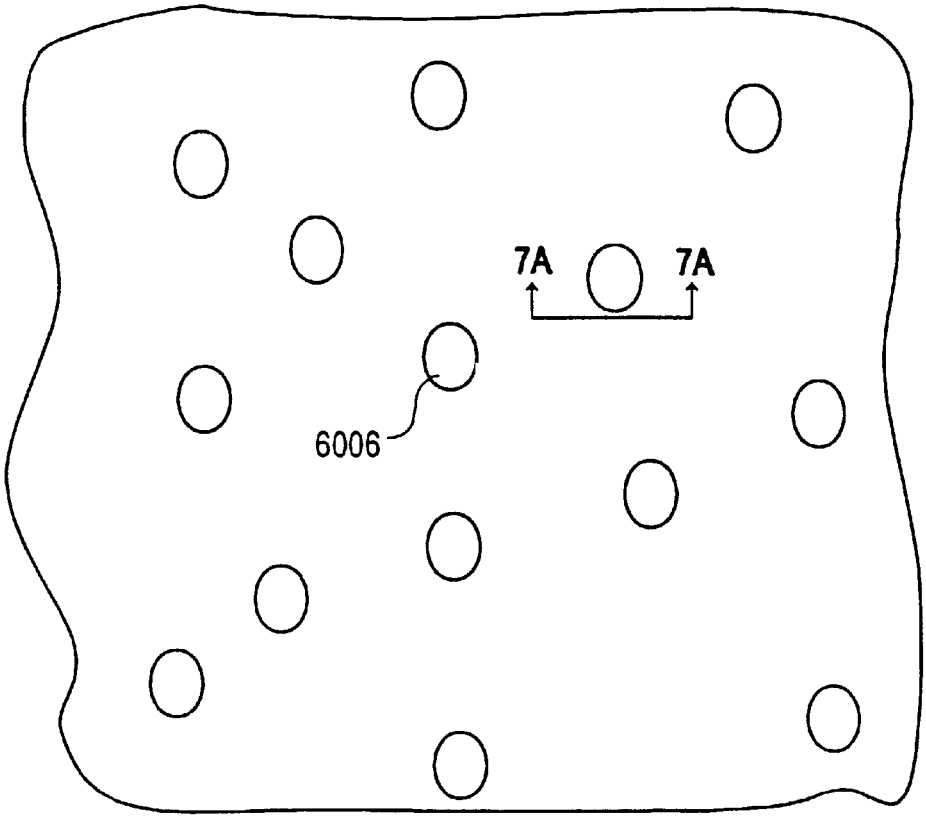

An example of such a ground shroud device is shown in FIGS. 7A and 7B. The ground mat 6001 may be formed from a plurality of separate mats 6003*a–c* and 6004*a–c* covered by the impermeable mat 6000 such as shown in FIG. 7A. The mats may be formed from compliant industrial mesh mats 6003 and/or perforated rubber or canvas 6004 or other similar types of flexible, deformable, perforated mats. The impermeable mat can be made from heavy rubber, conveyor belt or plastic sheet or from a lighter gauge sheet metal or from a combination of such materials layered together to form a strong but impermeable mat. Referring to FIG. 7B, several holes 6006 are formed in the mat as needed for drilling of successive holes and placement of successive small charge blasting shots in the holes.

If the ground shroud is used only for flyrock control, its layered construction may be simplified by using only one or two layers of material. For example, if used only for fly rock, the ground shroud can be made from one layer of heavy chain link mesh, or from two layers of lighter chain link mesh, or from a layer of lighter chain link mesh and a layer of heavy canvas or rubber mat and the upper impermeable layer omitted.

Enclosure for Pressure Wave and Flyrock Suppression

Enclosures for pressure wave and flyrock suppression are aimed at intercepting and controlling the expanded air-blast in the immediate vicinity of the small charge blast around the undercarrier or rig stationed at the working face as well as equipment noise and flyrock. An enclosure is erected over the boom of the undercarrier or around the entire undercarrier or, in the case of a shaft rig, over the entire shaft rig. The enclosure may not be strongly coupled to the rock to be broken (as is the case for the collar or ground shrouds) but can be suspended over the work area from an independent structure that may or may not be the undercarrier or rig. Thus the enclosure can be of a lighter weight construction than a collar shroud. Its function is to contain the expanded working fluid that escapes from the hole collar and/or ground fractures and fissures, and then slowly dissipate this expanded gas to the outside world. The enclosure may include controlled leakage vents to facilitate controlled dissipation of the gas.

The enclosure contains enough volume of atmospheric air to dilute and mix with the expanded working fluid. In the case of a flexible canopy, the mass of ambient air contained within the enclosure is substantially greater than the mass of energetic working fluid so that the diluted energy of the mixture is only slightly greater than the ambient energy of the air. In the case of a rigid enclosure, the volume of ambient air may be much less so that substantial momentary over-pressures may be developed but these can be contained by the enclosure.

Figure 8A:
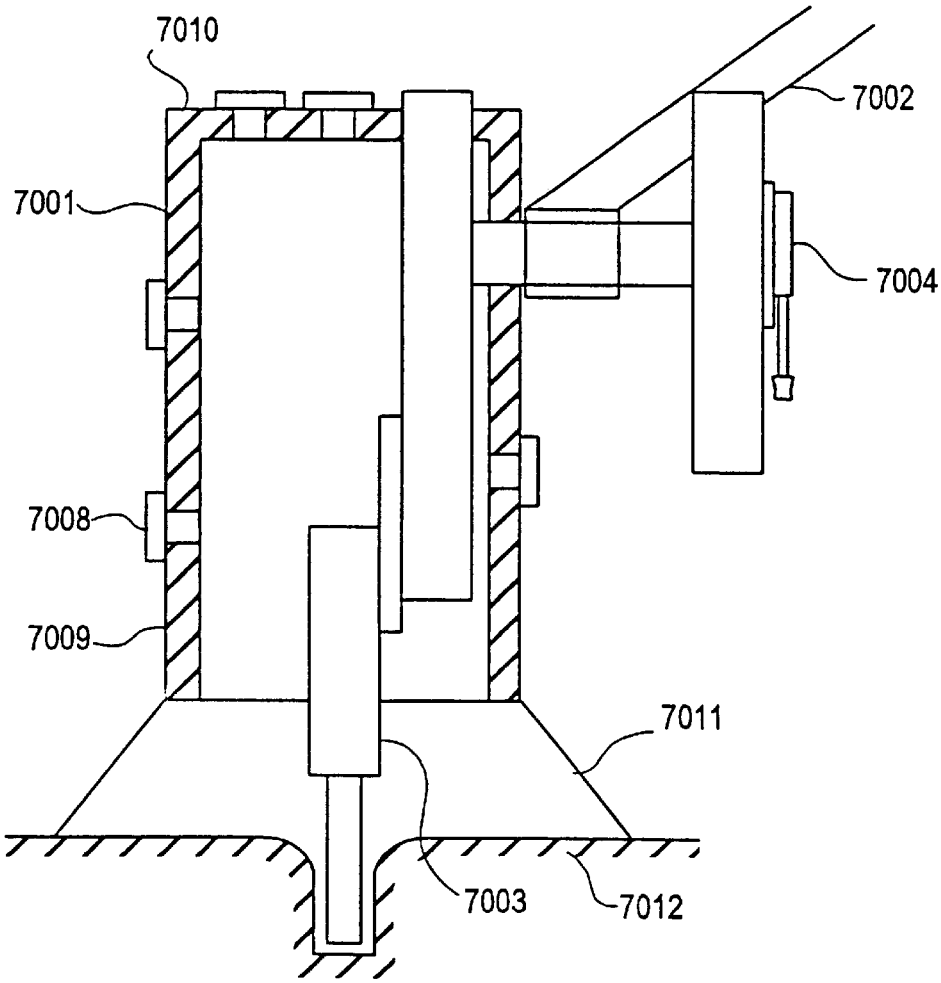
FIGS. 8A and 8B are respectively a cutaway side view and exploded view of a section through a wall of an enclosure that is attached to the proximal end of a boom of a small-charge blasting machine.
Figure 8B:
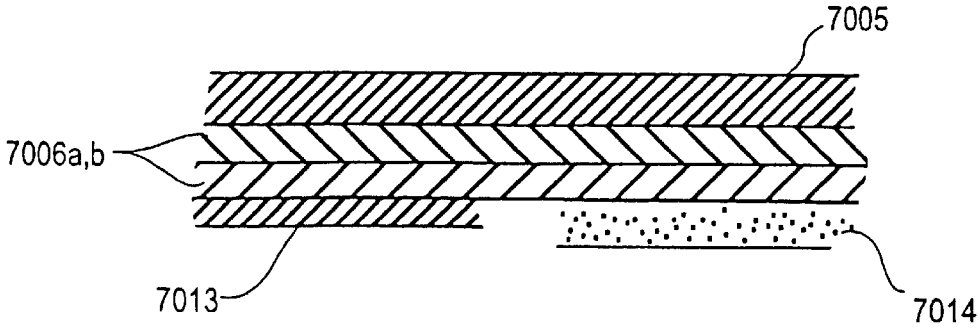

FIG. 8A shows a cutaway side view of a rigid type canopy 7001 that is attached to the end of a boom 7002 of a small-charge blasting machine. A sealing member 7003 is mounted on the boom 7002. There may be a rock drilling apparatus 7004 also attached to the boom 7002. The drilling apparatus 7004 is located outside of the canopy 7001. As shown in FIG. 8B, the enclosure 7001 is constructed of a heavy rigid outer shell 7005 (such as metallic plate) which may be lined on the inside with one or more thick rubber or canvas membranes 7006*a, b* which can both mitigate sound transmission through the shell 7005 and absorb flyrock impacts. The rigid canopy 7001 may have several large or many small holes or vents 7008 on its body 7009 or in its top 7010 to allow controlled venting of the gases during and after a shot. The enclosure 7001 may also have a flexible skirt 7011 that can form a rough seal 7012 with the ground to deflect the airblast and flyrock into the enclosure 7001. The inside of the enclosure 7001 may be further lined with a impact resistant layer 7013 for flyrock protection and/or with a pressure wave absorbent material 7014 for pressure wave mitigation.

Figure 8C:
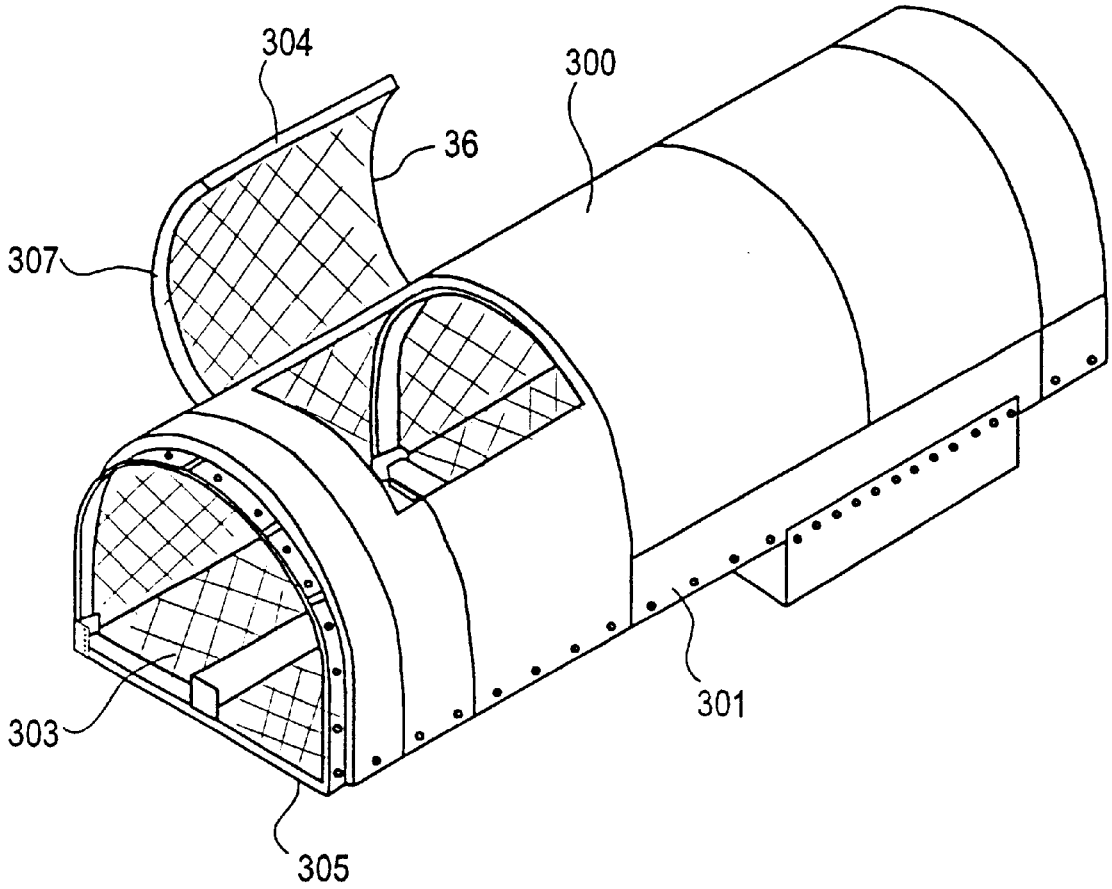
FIG. 8C is an isometric view of another configuration of an enclosure.

FIG. 8C depicts another configuration of a rigid-type canopy 300 that is designed to be attached to the feed holder or boom assembly of a small-charge blasting machine. In this embodiment, both the rock drill apparatus and the sealing member are housed in within the canopy 300 so that all pressure waves and machine noise as well as flyrock from the collar region are captured in the enclosure. The outside of the canopy 301 may be fabricated from sheet metal, light steel plate, or another heavy rigid material attached to a frame structure fabricated from wood, aluminum, steel, or other types of structural members. One or more pressure wave absorbing, dissipating, and/or reflecting layers 307 are used to line the interior of the enclosure. The layer 307 may be held in place and protected by a impact resistant layer 306 of heavy industrial plastic, rubber, canvas or metallic mesh 307 and the like that is impact resistant and capable of resisting flyrock. There is a hinged door 304 for access to the rock drill and/or small charge blasting device. In addition, there may be a relatively heavy layer or layers of industrial plastic, rubber, canvas, or other deformable material secured to the bottom of the canopy 305 to form a shroud around the drill hole.

Figure 8D:
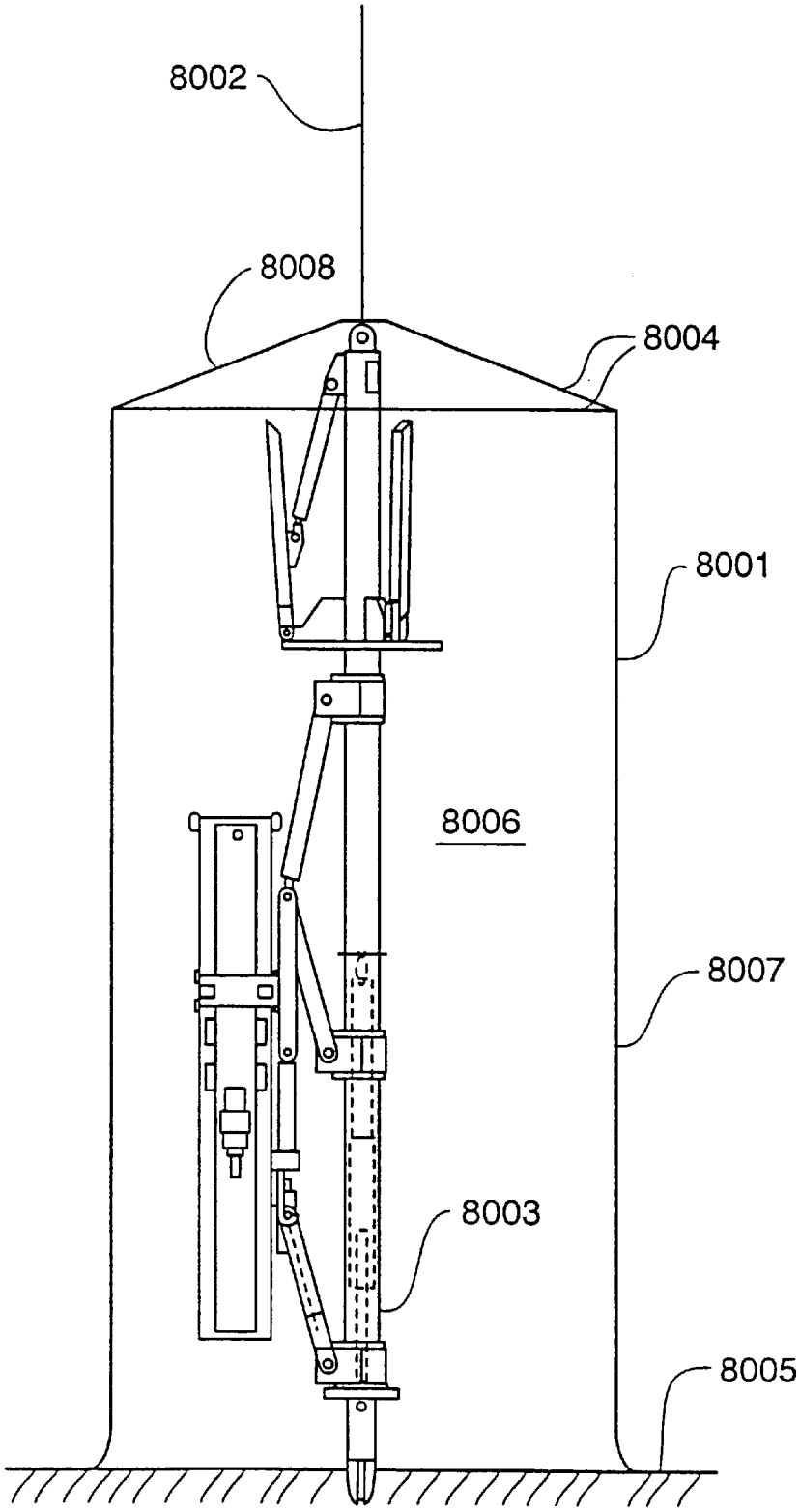
FIG. 8D is a cutaway side view of an enclosure that is affixed to the supporting cable such as might be used on an excavation apparatus for hole drilling, small charge blasting, and impact breaking in shaft excavation.

FIG. 8D shows a cutaway side view of a heavy flexible type canopy 8001 shown affixed to the supporting cable 8002 such as might be used on a small-charge blasting apparatus 8003 used for shaft excavation. The flexible canopy formed from heavy flexible materials such as industrial conveyor belt, heavy canvas or a flexible sandwich such as heavy aluminum foil on either side of an acoustic material (e.g. ethyl vinyl acetate, poly vinyl chloride or other such plastic or foamed materials) such that it will absorb and deaden the airblast and equipment noise. The enclosure should form a heavy flexible bag type structure to contain the over-pressure. The enclosure may have a flap or door that can be secured shut during firing of the shot. The canopy 8001 is attached to a rigid support frame 8004 that may be constructed from wood or structural steel members. The canopy 8001 is draped onto the ground to form a rough seal 8005. The volume 8006 inside the canopy is sufficient to dilute the energy of the airblast as described above. The canopy 8001 may have several large or many small holes on its body 8007 or in its top 8008 to allow controlled venting of the gases during and after a shot.

The internal volume of the flexible canopy is preferably in the range of about 50 $m^3$ to 200 $m^3$, more preferably in the range of about 50 $m^3$ to 100 $m^3$, and most preferably in the range of about 75 $m^3$ to 100 $m^3$. The internal volume of the rigid enclosure is preferably in the range of about 1 $m^3$ to 10 $m^3$, more preferably in the range of about 2 $m^3$ to 10 $m^3$, and most preferably in the range of about 2 $m^3$ to 5 $m^3$.

The enclosures described above can be used to contain equipment other than a small charge blasting device to suppress pressure waves. For example, the enclosures can contain a drill, an impact breaker, and the like.

Pressure Wave and Flyrock Suppression Barriers

The pressure wave and flyrock suppression barriers intercept, absorb and/or deflect the noise or substantially weakened air-blast in the intermediate to far-field region of the small charge blast. Barriers of sound absorbent material are erected between the work area and the areas to be protected from noise (buildings, residences, playgrounds etc). The barriers are located such that they absorb and/or deflect the noise energy up and over or away from the areas to be protected. In the case of a shaft work area, the noise barriers may be assembled as a lining for the shaft.

This same apparatus can also be used for intercepting any flyrock that escapes the immediate working area. In addition to being located to best absorb and deflect noise, the barriers are located such that they will also intercept any direct line of flight, high velocity flyrock; or lower velocity flyrock that is follows an arched trajectory. It may be necessary to protect any layers of noise absorbing material lining the inside of the barrier with a layer of mesh or other material that can absorb the impact of flyrock while protecting the noise absorbent material.

Figure 9:
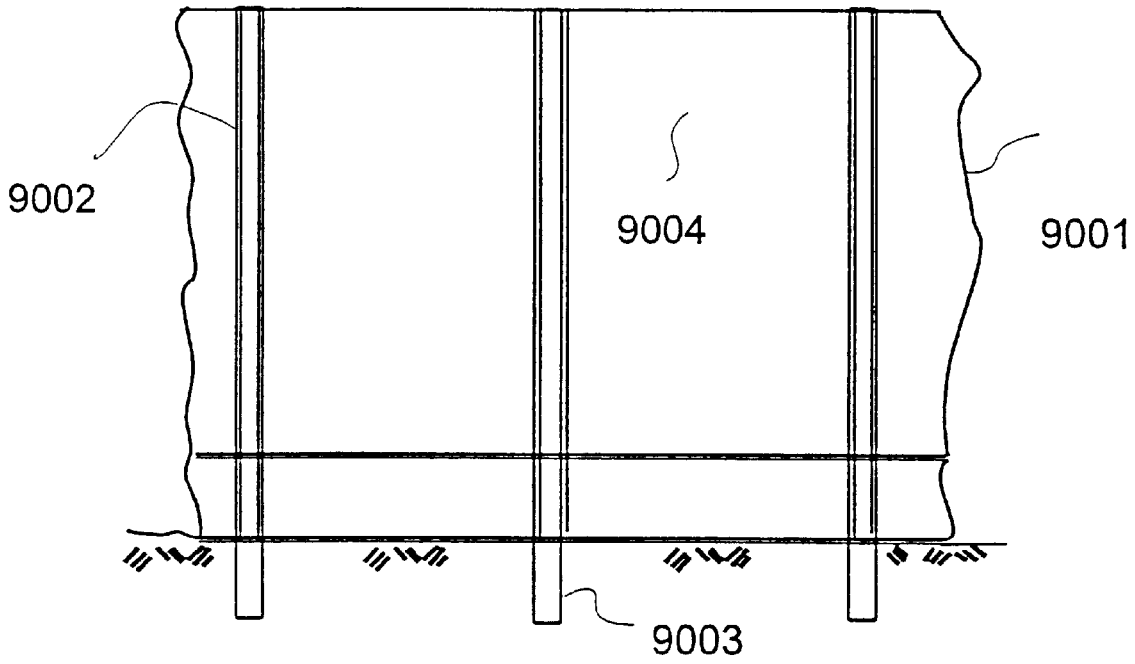
FIG. 9 is a cutaway side view of a moveable barrier for pressure wave suppression and flyrock control.
Figure 10:
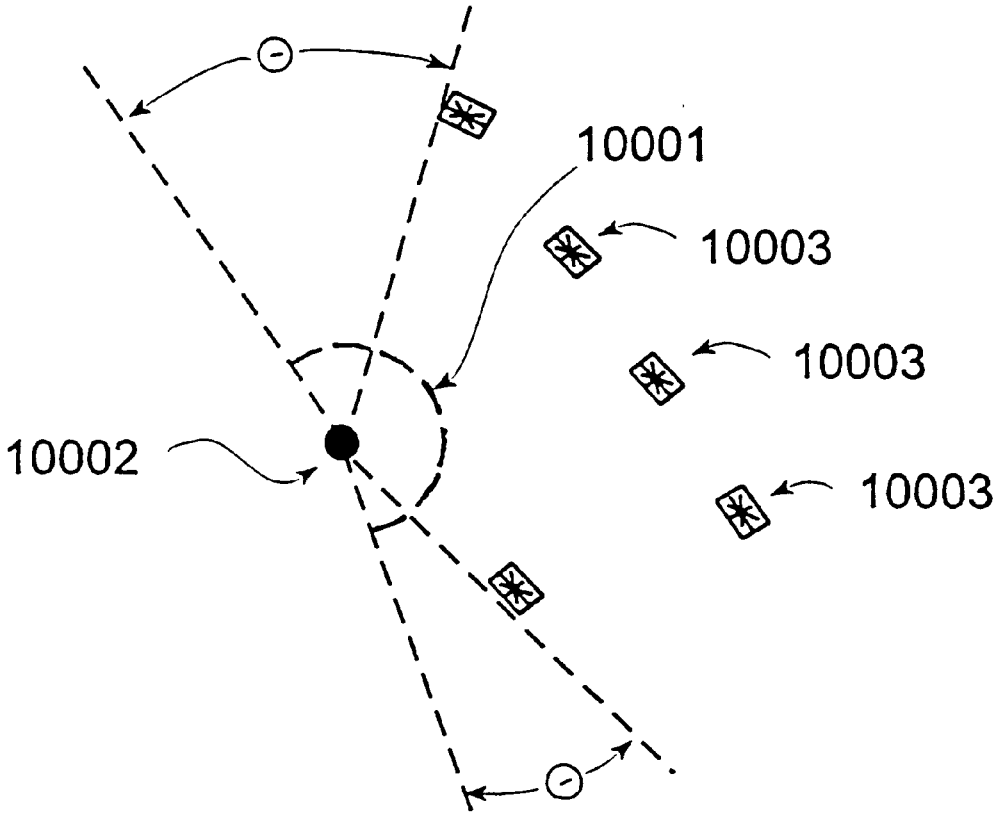
FIG. 10 is a plan view of a layout of the relative positions of pressure wave-flyrock barriers might be deployed to protect an area from the small-charge blasting work site.

FIG. 9 shows a cutaway side view of the construction for a pressure wave and flyrock suppression barrier 9001. The barrier frame 9002 may be constructed from wood beams or structural steel members. The vertical members may be inserted into holes 9003 in the ground for support if the barriers are free-standing. The main barrier structure or skin 9004 may be made from plywood or sheet metal and covered with sound absorbent material such as acoustic tile, heavy canvas or industrial conveyor belt. FIG. 10 shows how such barriers 10001 may be deployed around a work site 10002 to protect airblast and flyrock sensitive areas 10003. The angle "θ" defined by a line extending from the work site 10002 to the structure and a line extending from the work site to the end of the barrier 10001 is typically at least about 30 and no more than about 90 degrees with about 45 degrees being preferred.

Stand alone barriers may be typically 2 to 4 meters high and anchored typically 0.5 to 1 meters into the ground.

Atomization Device for Suppressing Airblast

The airblast that escapes from the drill hole or fragmented rock around the shot point, moves at a velocity equal to or greater than the speed of sound. The pulse width of the airblast immediately around the shot point is on the order of a few milliseconds. It is possible to extract energy from the airblast or escaping working fluid by causing it to pass through a cloud of atomized fluid particles or spray. The spray must be atomized to increase the surface area of spray particles. For a given mass of fluid, the total surface area is proportional to the cube root of the number of droplets. The mechanism of extracting energy is by convective and conductive heat transfer of hot gases to fluid particles. If the amount of spray is large enough and the atomization is fine enough, then the resultant fog cloud can extract significant energy from the airblast and expanded working fluid, and therefore reduce the amplitude and pulse width of the airblast near the source. The atomized fluid spray has the advantage that it is relatively easy to generate and apply compared to some of the mechanical airblast suppression apparatuses. Further, the spray has the beneficial side effect of helping to suppress dust.

To achieve effective heat transfer of a significant portion of the airblast energy, it is necessary to envelope the work face with a large volume of fluid such as water in a highly atomized state. The droplet size ranges preferably from about 1 mm to 0.01 mm, more preferably from about 0.5 mm to 0.01 mm and most preferably from about 0.1 mm to 0.01 mm. The volume of fluid suspended around the working face at the time of firing is dependent on the charge weight of the explosive or propellant used. The volume of fluid ranges preferably from about 10 liters per kg of charge to 2000 liters per kg, more preferably from about 50 liters per kg to 2000 liters per kg and most preferably from about 100 liters per kg to 2000 liters per kg.

Figure 11:
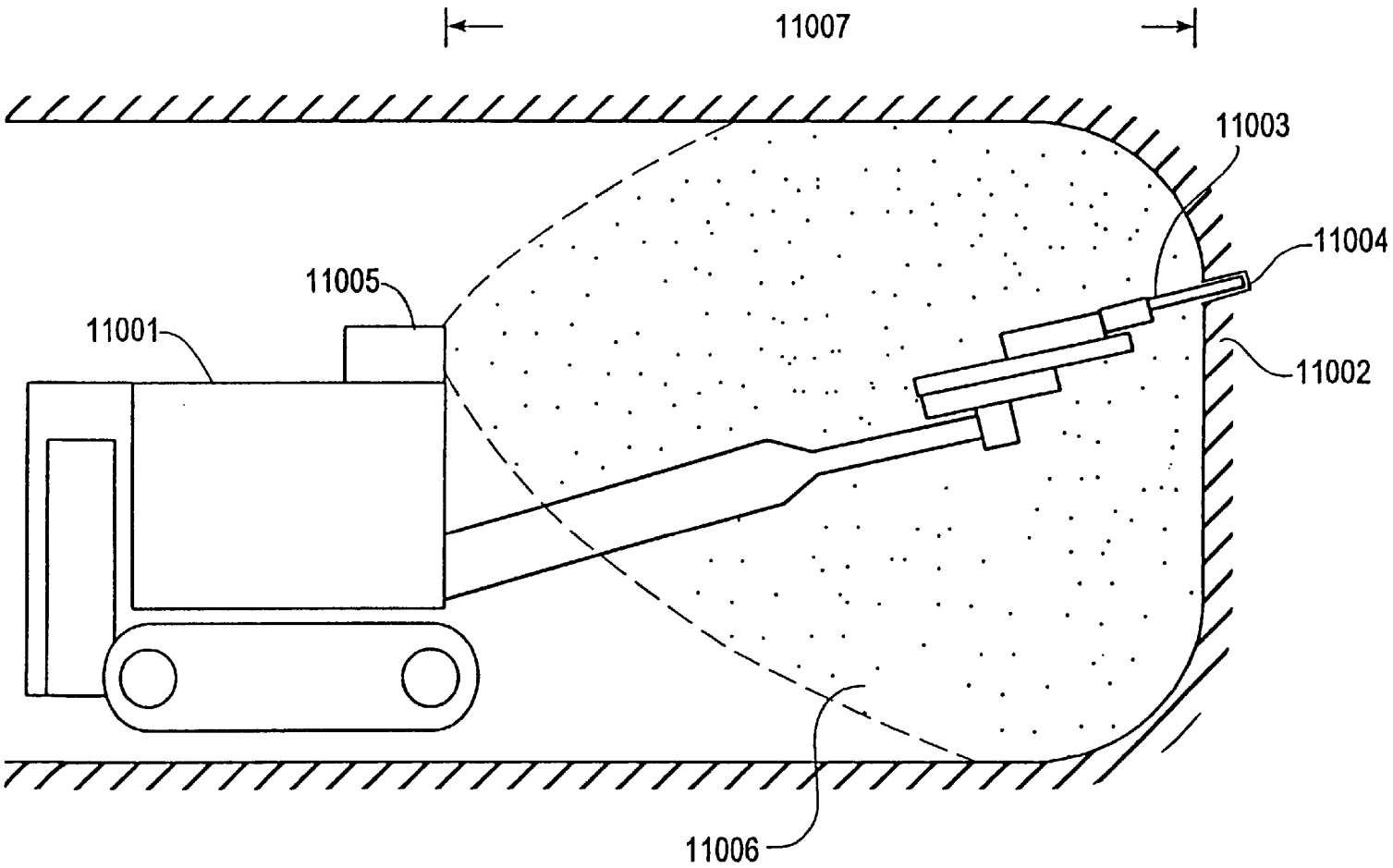
FIG. 11 is a side view of a small charge excavation machine in firing position with an atomized spray pattern for pressure wave suppression.

FIG. 11 shows a typical small charge excavation machine 11001 in firing position at the work face 11002. A small charge blasting device 11003 is positioned in a drill hole 11004. A spray system 11005 for atomizing a fluid such as water may be mounted on the machine 11001 and used to create a spray pattern 11006 that envelopes the working area 11007 between the machine 11001 and the drill hole 11004.

Figure 12:
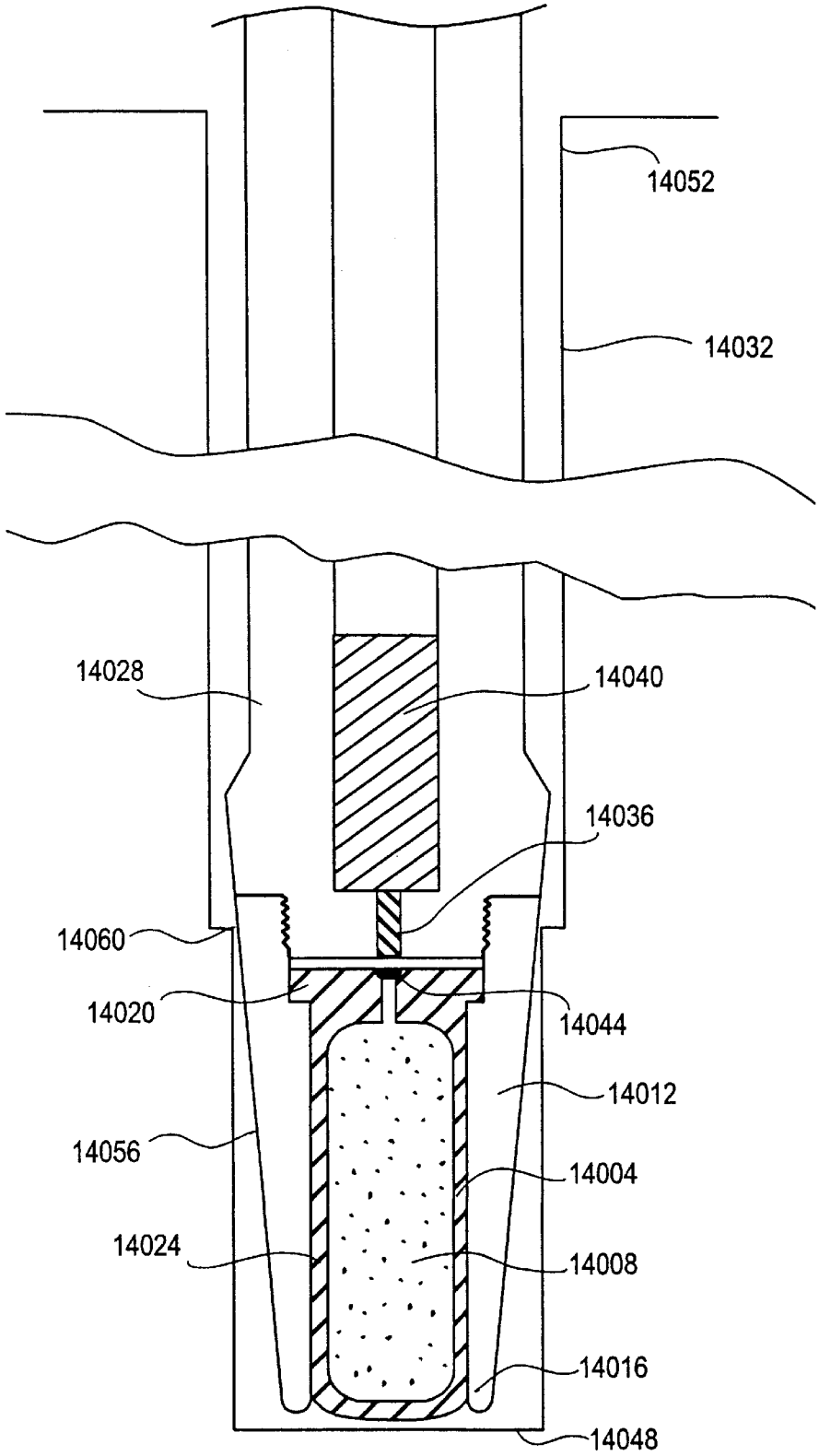
FIG. 12 is a cross-sectional side view of a gas generator according to one embodiment.

An embodiment of a novel gas generator device that may be used as part of the present invention to introduce a pressurized working fluid rapidly into a portion of the drill hole and to seal the hole is shown in FIG. 12. It includes a cartridge 14004 containing a propellant charge 14008 which is hand-inserted into a cartridge housing 14012. The cartridge 14004 may be contained completely inside the cartridge housing 14012 or the distal end of the cartridge 14004 may protrude a small distance beyond the muzzle end 14016 of the cartridge housing 14012 (typically about one third or less of the overall cartridge length protrudes beyond the muzzle end 14016 of the cartridge housing). The cartridge 14004 may be made with a metallic base 14020 attached to a plastic cartridge body 14024. Alternately, the cartridge 14004 may be formed from only one material such as a plastic, compressed paper, or any other suitable material including combustible material used for consumable ammunition.

When the cartridge 14004 has been inserted, the cartridge housing 14012 is then attached to the end of a long stemming bar 14028 by means of a full thread, an interrupted thread, a bayonet type lug, or another suitable attachment mechanism. The stemming bar 14028, which is usually attached to an undercarrier by means of an extension cylinder, is inserted into a drill hole 14032 such that the cartridge housing 14012 comes to rest at or near the bottom of the hole. It can be appreciated that the stemming bar can be mounted to any suitable undercarriage, that may or may not include a drill performing the drilling function.

When the device is fully inserted, the propellant 14008 in the cartridge 14004 is initiated and the propellant 14008 is burned to completion generating a controlled high pressure in the bottom portion of the hole. The propellant 14008 may be initiated by a mechanical firing pin 14036, which is itself actuated by a firing pin assembly 14040, striking a percussion primer 14044 inserted in the cartridge base 14020. Alternately, an electric primer may be used and initiated by a current pulse transmitted through an electrical contact with a wire pair running down the stemming bar. The initiator can utilize any other initiation method, including inductive coupling.

Currently, the drill hole 14032 is formed by a reamer/pilot bit combination such that the distal portion 14048 of the drill hole 14032 is a smaller diameter than the proximal portion 14052 of the drill hole 14032. The outside of the cartridge housing 14012 has a slight taper 14056 (smaller diameter towards the distal end) so that the insertion will be stopped when the outside of the cartridge housing 14012 comes to rest on the step or ridge 14060 formed between the distal portion 14048 and the proximal portion 14052 of the drill hole 14032. The taper 14056 is preferably in the range of 0.5 to 3 degrees and most preferably in the range of 0.5 to 1.5 degrees.

Figure 13:
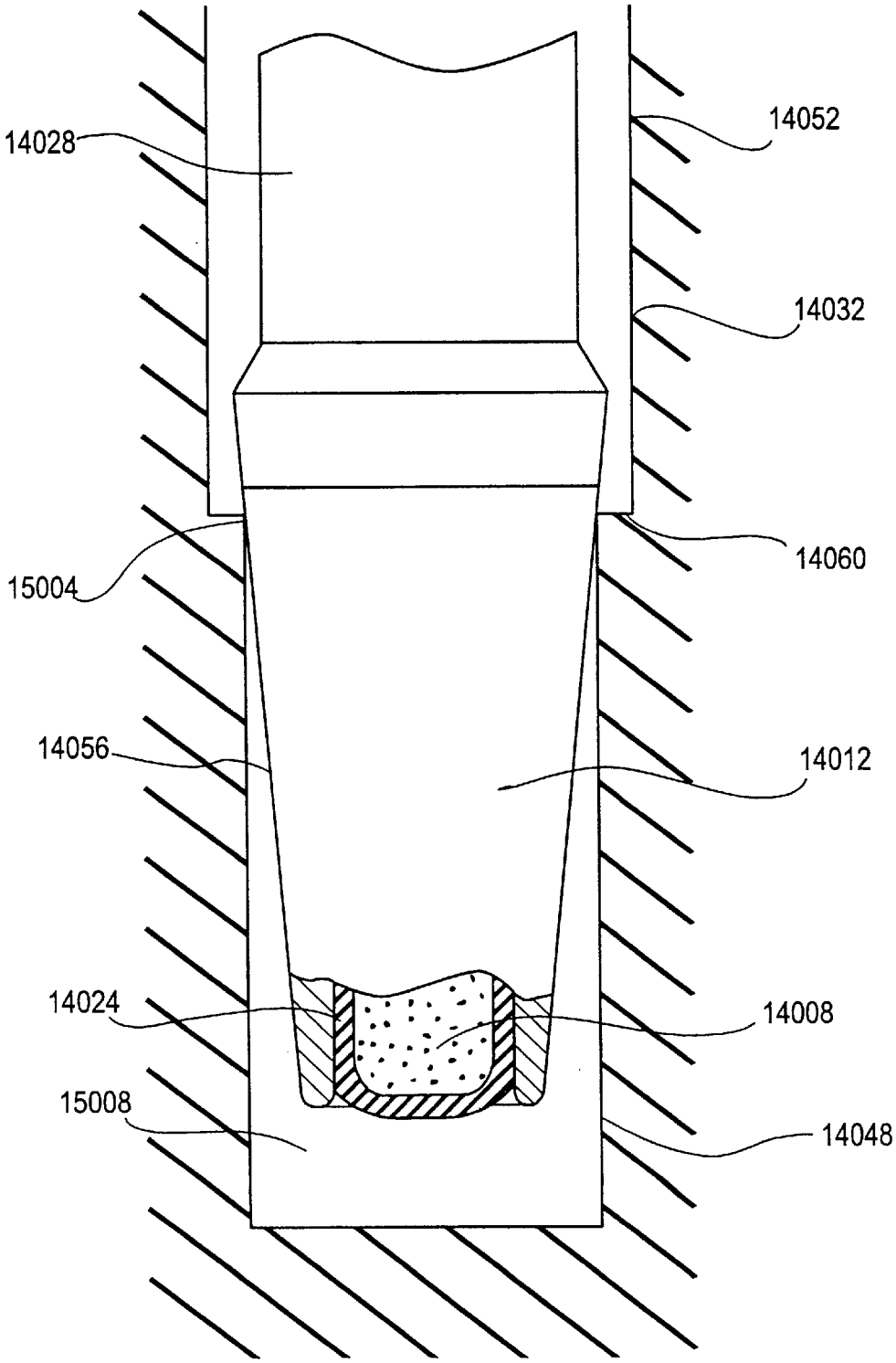
FIG. 13 is a partially cutaway side view of the gas generator of FIG. 12.

As illustrated in FIG. 13, the ridge 14060 of the stepped drill hole 14032 and the taper 14056 of the cartridge housing 14012 form a seal 15004 restricting the flow of pressurized gas in the hole bottom 15008 during the rock-breaking process. The partial cut-away at the distal end of the cartridge housing 14012 illustrates that the cartridge body 14024 and the propellant 14008 are positioned within the cartridge housing 14012.

Figure 14:
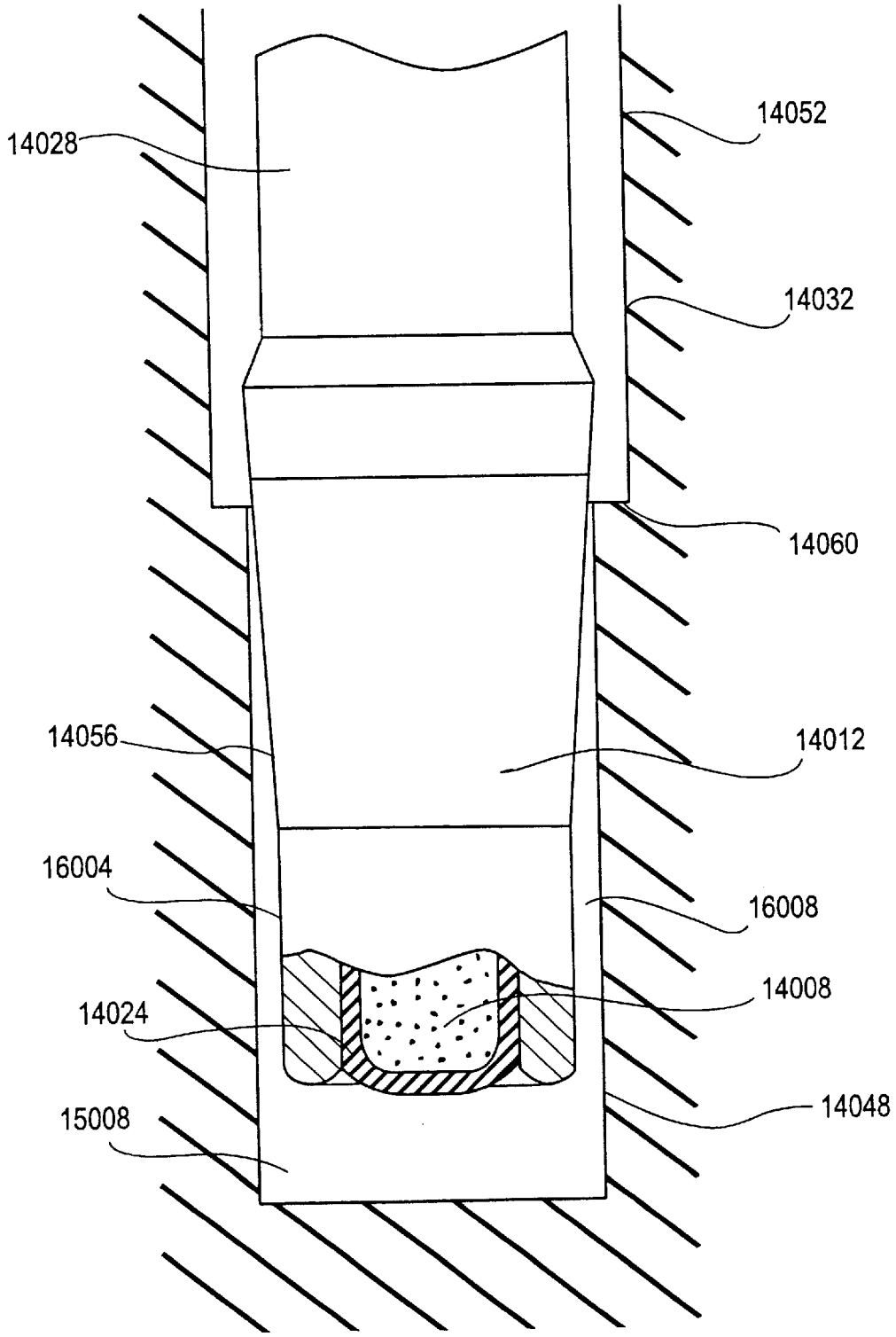
FIG. 14 is a partially cutaway side view of a gas generator according to another embodiment.

Alternate sealing techniques are also possible. For example, as illustrated in FIG. 14, the cartridge housing 14012 may have a straight, constant diameter portion 16004 at its tip that is a reasonably tight fit in the distal portion 14048 of the drill hole 14032. This sealing method provides a gap 16008 that remains roughly constant, even as the device recoils away from the hole bottom 15008 after firing.

The diameter of the distal portion 14048 of the drill hole 14032 is preferably in the range of 30 to 150 mm and most preferably in the range of 50 to 120 mm. The amount of propellant 14008 is preferably in the range of 100 to 750 grams and most preferably in the range of 200 to 450 grams. The length (L) of the pilot hole (distal portion 14048 of the drill hole 14032), expressed in terms of bottom hole diameters (D), is preferably in the L/D range of 0.5 to 6 and most preferably in the L/D range of 1 to 3. The total volume available to the high pressure propellant gas products is such that the average density of the gas is preferably in the range of 100 to 750 $kg/m^3$ and most preferably in the range of 200 to 500 $kg/m^3$.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A method for selecting one or more pressure wave suppression devices for use in a small-charge blast in which a material is broken by a pressurized working fluid released into or generated in a hole in the material and sealed in the hole by a sealing member positioned in the hole, the material being near an area that is subject to pressure wave restrictions, the method comprising:

(a) determining a pressure wave level requirement at a selected distance from at least a portion of the material to be broken;

(b) determining an unsuppressed pressure wave level at the selected distance produced by the small-charge blast in the absence of a pressure wave suppression device;

(c) comparing the pressure wave level requirement with the unsuppressed pressure wave level to determine a desired degree of pressure wave suppression;

(d) comparing the desired degree of pressure wave suppression with a degree of pressure wave suppression for each of a plurality of pressure wave suppression devices; and (e) selecting one or more pressure wave suppression devices from among the plurality of pressure wave suppression devices to produce a desired degree of pressure wave suppression.

2. The method of claim 1, wherein the plurality of pressure wave suppression devices include at least two of the following pressure suppression devices:

(i) a downhole pressure wave suppression device located in the hole in the material for directing flow of the working fluid through one or more nonlinear pathways, (ii) a downhole pressure wave suppression device located in the hole for contacting at least a portion of the working fluid with a thermal energy absorbing material having a plurality of heat transfer surfaces, (iii) a collar pressure wave suppression device located at or near the opening of the hole for directing flow of the working fluid through one or more nonlinear pathways, (iv) a collar pressure wave suppression device located at or near the opening of the hole for contacting at least a portion of the working fluid with a thermal energy absorbing material having a plurality of heat transfer surfaces, (v) a mat positioned on the surface of the material to be broken around the hole opening for directing flow of the working fluid through one or more nonlinear pathways in the mat;

(vi) a mat positioned on the surface of the material to be broken around the hole opening for absorbing thermal energy from the working fluid by contacting the working fluid with a plurality of heat transfer surfaces of the mat, (vii) an enclosure substantially surrounding and enclosing the hole opening for containing the working fluid and impeding the discharge of the working fluid into the ambient atmosphere, (viii) a barrier located between the hole opening and the area for absorbing and/or deflecting at least a portion of the pressure wave energy, and (ix) a plurality of atomized liquid droplets suspended in the air adjacent to the material to absorb thermal energy from the working fluid.

3. The method of claim 1, wherein in step (e) three or more of the pressure wave suppression devices are selected and used during the small charge blast.

4. The method of claim 1, wherein the determining step (a)includes:

determining at least one of a machine pressure wave requirement and a personnel pressure wave requirement;

determining a job pressure wave requirement, the job pressure wave requirement being the maximum allowable pressure wave level for the pressure wave restricted area; and comparing the at least one of a machine pressure wave requirement and personnel pressure wave requirement with the job pressure wave requirement with the more restrictive of the at least one of a machine pressure wave requirement and a personnel pressure wave requirement and the job pressure wave requirement being the pressure wave level requirement.

5. The method of claim 4, wherein the at least one of a machine pressure wave requirement and a personnel pressure wave requirement includes both the machine pressure wave requirement and the personnel pressure wave requirement.

6. The method of claim 1, further comprising:

determining at least two of a job flyrock distance requirement, a personnel flyrock distance requirement, and a machine flyrock distance requirement.

7. The method of claim 6, further comprising:

comparing the at least two of a job flyrock distance requirement, a personnel flyrock distance requirement, and a machine flyrock distance requirement to determine a flyrock distance requirement.

8. The method of claim 7, further comprising:

comparing the flyrock distance requirement with an uncontrolled flyrock distance to determine whether protection against flyrock is required.

9. The method of claim 1, wherein the sealing member is attached to a machine and the machine remains at or above the hole during the small charge blast.

10. The method of claim 2, wherein in the selecting step the mat of (v) or (vi) is selected and further comprising at least one of:

inserting sequentially a drill through the mat to form a plurality of holes; and inserting sequentially the sealing member through the mat into a plurality of holes in the material, wherein in both inserting steps the mat remains in a fixed position.

11.The method of claim 1, further comprising repeating steps (a) through (c) for a pressure wave-generating function in the small-charge blasting process that is different from the small charge blast.

12. The method of claim 2, wherein in step (e) at least one of device (i), device (ii), device (iii), and device (iv) is selected.

13. The method of claim 1, wherein (i) step (a) comprises determining at least two of a job pressure wave requirement, a machine pressure wave requirement, and a personnel pressure wave requirement; (ii) step (b) comprises determining a corresponding unsuppressed pressure wave level for each of the at least two of a job pressure wave requirement, a machine pressure wave requirement, and a personnel pressure wave requirement at a corresponding selected distance from at least a portion of the material to be broken; (iii) step (c) comprises comparing the at least two of a job pressure wave requirement, a machine pressure wave requirement, and a personnel pressure wave requirement with the corresponding unsuppressed pressure wave level to determine a corresponding degree of pressure wave suppression; and (iv) steps (d) and (e) are repeated for each of the corresponding degrees of pressure wave suppression.

14. A system for selecting one or more pressure wave suppression devices for use in a small-charge blast in which a material is broken by a pressurized working fluid released into or generated in a hole in the material and sealed in the hole by a sealing member positioned in the hole, the material being near an area that is subject to pressure wave restrictions, the system comprising:

(a) means for determining a pressure wave level requirement at a selected distance from at least a portion of the material to be broken;

(b) means for determining an unsuppressed pressure wave level at the selected distance produced by the small-charge blast in the absence of a pressure wave suppression device;

(c) means for comparing the pressure wave level requirement with the unsuppressed pressure wave level to determine a desired degree of pressure wave suppression;

(d) means for comparing the desired degree of pressure wave suppression with a degree of pressure wave suppression for each of a plurality of pressure wave suppression devices; and (e) means for selecting one or more pressure wave suppression devices from among the plurality of pressure wave suppression devices to produce a desired degree of pressure wave suppression.

15. The system of claim 14, wherein the plurality of pressure wave suppression devices include at least two of the following pressure suppression devices:

(i) a downhole pressure wave suppression device located in the hole for directing flow of the working fluid through one or more nonlinear pathways, (ii) a downhole pressure wave suppression device located in the hole for contacting at least a portion of the working fluid with a thermal energy absorbing material having a plurality of heat transfer surfaces, (iii) a collar pressure wave suppression device located at or near the opening of the hole for directing flow of the working fluid through one or more nonlinear pathways, (iv) a collar pressure wave suppression device located at or near the opening of the hole for contacting at least a portion of the working fluid with a thermal energy absorbing material having a plurality of heat transfer surfaces, (v) a mat positioned on the surface of the material to be broken around the hole opening for directing flow of the working fluid through one or more nonlinear pathways in the mat;

(vi) a mat positioned on the surface of the material to be broken around the hole opening for absorbing thermal energy from the working fluid by contacting the working fluid with a plurality of heat transfer surfaces of the mat, (vii) an enclosure substantially surrounding and enclosing the hole opening for containing the working fluid and impeding the discharge of the working fluid into the ambient atmosphere, (viii) a barrier located between the hole opening and the area for absorbing and/or deflecting at least a portion of the pressure wave energy, and (ix) a plurality of atomized liquid droplets suspended in the air adjacent to the material to absorb thermal energy from the working fluid.

16. The system of claim 14, wherein the selecting means selects three or more of the pressure wave suppression devices.

17. The system of claim 14, wherein the determining means (a) includes:

means for determining at least one of a machine pressure wave requirement and a personnel pressure wave requirement;

means for determining a job pressure wave requirement, the job pressure wave requirement being the maximum allowable pressure wave level for the pressure wave restricted area; and means for comparing the at least one of a machine pressure wave requirement and personnel pressure wave requirement with the job pressure wave requirement with the more restrictive of the at least one of a machine pressure wave requirement and a personnel pressure wave requirement and the job pressure wave requirement being the pressure wave level requirement.

18. The system of claim 17, wherein the at least one of a machine pressure wave requirement and a personnel pressure wave requirement includes both the machine pressure wave requirement and the personnel pressure wave requirement.

19. The system of claim 14, further comprising:

means for determining at least two of a job flyrock distance requirement, a personnel flyrock distance requirement, and a machine flyrock distance requirement.

20. The system of claim 19, further comprising:

means for comparing the at least two of a job flyrock distance requirement, a personnel flyrock distance requirement, and a machine flyrock distance requirement to determine a flyrock distance requirement.

21. The system of claim 20, further comprising:

means for comparing the flyrock distance requirement with an uncontrolled flyrock distance to determine whether protection against flyrock is required.

22. The system of claim 14, wherein the sealing member is attached to a machine and the machine remains above the hole during the small charge blast.

23. The system of claim 15, wherein the selecting means selects the mat of (v) or (vi) and further comprising at least one of:

means for inserting sequentially a drill through the mat to form a plurality of holes;

means for inserting sequentially the sealing member through the mat into a plurality of holes in the material, wherein the mat remains in a fixed position during insertion of the drill and sealing member.

24. The system of claim 15, wherein the selecting means selects at least one of device (i), device (ii), device (iii), and device (iv).

25. The system of claim 14, wherein (i) determining means (a) comprises means for determining at least two of a job pressure wave requirement, a machine pressure wave requirement, and a personnel pressure wave requirement; (ii) determining means (b) comprises means for determining a corresponding unsuppressed pressure wave level for each of the at least two of a job pressure wave requirement, a machine pressure wave requirement, and a personnel pressure wave requirement at a corresponding selected distance from at least a portion of the material to be broken; and (iii) comparing means (c) comprises means for comparing the at least two of a job pressure wave requirement, a machine pressure wave requirement, and a personnel pressure wave requirement with the corresponding unsuppressed pressure wave level to determine a corresponding degree of pressure wave suppression.

26. A method for selecting one or more pressure wave suppression devices for use in a small-charge blast in which a material is broken by a pressurized working fluid released into or generated in a hole in the material and sealed in the hole by a sealing member positioned in the hole, the material being near an area that is subject to pressure wave restrictions, the method comprising:

(a) providing a pressure wave level requirement at a selected distance from at least a portion of the material to be broken and an unsuppressed pressure wave level at the selected distance produced by the small-charge blast in the absence of a pressure wave suppression device;

(b) comparing the pressure wave level requirement with the unsuppressed pressure wave level to determine a desired degree of pressure wave suppression;

(c) comparing the desired degree of pressure wave suppression with a degree of pressure wave suppression for each of a plurality of pressure wave suppression devices; and (d) selecting one or more pressure wave suppression devices from among the plurality of pressure wave suppression devices to produce a desired degree of pressure wave suppression.

27. The method of claim 26, wherein the providing step (a) includes:

providing at least one of a machine pressure wave requirement and a personnel pressure wave requirement;

providing a job pressure wave requirement, the job pressure wave requirement being the maximum allowable pressure wave level for the pressure wave restricted area; and comparing the at least one of a machine pressure wave requirement and personnel pressure wave requirement with the job pressure wave requirement with the more restrictive of the at least one of a machine pressure wave requirement and a personnel pressure wave requirement and the job pressure wave requirement being the pressure wave level requirement.

28. The method of claim 27, wherein the at least one of a machine pressure wave requirement and a personnel pressure wave requirement includes both the machine pressure wave requirement and the personnel pressure wave requirement.

29. The method of claim 26, further comprising:

providing at least two of a job flyrock distance requirement, a personnel flyrock distance requirement, and a machine flyrock distance requirement.

30. The method of claim 29, further comprising:

comparing the at least two of a job flyrock distance requirement, a personnel flyrock distance requirement, and a machine flyrock distance requirement to determine a flyrock distance requirement.

31. The method of claim 30, further comprising:

comparing the flyrock distance requirement with an uncontrolled flyrock distance to determine whether protection against flyrock is required.

32. The method of claim 30, wherein the sealing member is attached to a machine and the machine remains at or above the hole during the small charge blast.

33. The method of claim 30, further comprising repeating steps (a) through (b) for a pressure wave-generating function in the small-charge blasting process that is different from the small charge blast.

34. The method of claim 35, wherein in step (d) at least one of device (i), device (ii), device (iii), and device (iv) is selected.

35. The method of claim 30, wherein (i) step (a) comprises providing at least two of a job pressure wave requirement, a machine pressure wave requirement, and a personnel pressure wave requirement; (ii) step (a) comprises providing a corresponding unsuppressed pressure wave level for each of the at least two of a job pressure wave requirement, a machine pressure wave requirement, and a personnel pressure wave requirement at a corresponding selected distance from at least a portion of the material to be broken; (iii) step (b) comprises comparing the at least two of a job pressure wave requirement, a machine pressure wave requirement, and a personnel pressure wave requirement with the corresponding unsuppressed pressure wave level to determine a corresponding degree of pressure wave suppression; and (iv) steps (c) and (d) are repeated for each of the corresponding degrees of pressure wave suppression.

36. The method of claim 26, wherein the plurality of pressure wave suppression devices includes at least two of the following pressure suppression devices:

(i) a downhole pressure wave suppression device located in the hole in the material for directing flow of the working fluid through one or more nonlinear pathways, (ii) a downhole pressure wave suppression device located in the hole for contacting at least a portion of the working fluid with a thermal energy absorbing material having a plurality of heat transfer surfaces, (iii) a collar pressure wave suppression device located at or near the opening of the hole for directing flow of the working fluid through one or more nonlinear pathways, (iv) a collar pressure wave suppression device located at or near the opening of the hole for contacting at least a portion of the working fluid with a thermal energy absorbing material having a plurality of heat transfer surfaces, (v) a mat positioned on the surface of the material to be broken around the hole opening for directing flow of the working fluid through one or more nonlinear pathways in the mat;

(vi) a mat positioned on the surface of the material to be broken around the hole opening for absorbing thermal energy from the working fluid by contacting the working fluid with a plurality of heat transfer surfaces of the mat, (vii) an enclosure substantially surrounding an enclosing the hole opening for containing the working fluid and impeding the discharge of the working fluid into the ambient atmosphere, (viii) a barrier located between the hole opening and the area for absorbing and/or deflecting at least a portion of the pressure wave energy, and (ix) a plurality of atomized liquid droplets suspended in the air adjacent to the material to absorb thermal energy from the working fluid.

* * * * *